US010710109B2

(12) United States Patent
Kulkarni et al.

(10) Patent No.: US 10,710,109 B2
(45) Date of Patent: Jul. 14, 2020

(54) SPRAY NOZZLE DEVICE FOR DELIVERING A RESTORATIVE COATING THROUGH A HOLE IN A CASE OF A TURBINE ENGINE

(71) Applicant: General Electric Company, Schenectady, NY (US)

(72) Inventors: Ambarish Jayant Kulkarni, Niskayuna, NY (US); Hrishikesh Keshavan, Niskayuna, NY (US); Mehmet Dede, Cincinnati, OH (US); Bernard Patrick Bewlay, Niskayuna, NY (US); Guanghua Wang, Clifton Park, NY (US); Byron Pritchard, Cincinnati, OH (US); Michael Solomon Idelchik, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/812,617

(22) Filed: Nov. 14, 2017

(65) Prior Publication Data

US 2019/0143358 A1 May 16, 2019

(51) Int. Cl.
*B05B 13/06* (2006.01)
*B05B 1/04* (2006.01)
(Continued)

(52) U.S. Cl.
CPC ..... *B05B 13/0627* (2013.01); *B05B 1/044* (2013.01); *B05B 1/046* (2013.01);
(Continued)

(58) Field of Classification Search
CPC .. B05C 7/00; B05C 7/005; B05C 7/02; B05C 11/1034; B05C 11/1044; B05C 5/0291;
(Continued)

(56) References Cited

U.S. PATENT DOCUMENTS 4,195,779 A 4/1980 Auclair et al.
4,714,199 A 12/1987 Heath et al.
(Continued)

FOREIGN PATENT DOCUMENTS

EP 1813352 A1 8/2007
EP 3202526 A1 8/2017
WO 2017040314 A1 3/2017

OTHER PUBLICATIONS

Office Action dated Dec. 23, 2019 for corresponding Canadian Application No. 3,023,689 (3 pages).
(Continued)

*Primary Examiner* — Laura Edwards
(74) *Attorney, Agent, or Firm* — Christopher R. Carroll; The Small Patent Law Group LLC

(57) ABSTRACT

An atomizing spray nozzle device includes plural inlets that receive different phases of materials of a coating. The device also includes an atomizing zone housing portion fluidly coupled with the inlets and shaped to mix the different phases of the materials into a mixed phase slurry. The device also includes a plenum housing portion fluidly coupled with the atomizing housing portion along the center axis of the device. The plenum housing portion includes an interior plenum that is elongated along the center axis of the device. The plenum is configured to receive the mixed phase slurry from the atomizing zone. The device also includes one or more delivery nozzles fluidly coupled with the plenum. The one or more delivery nozzles provide one or more outlets from which the mixed phase slurry is delivered onto one or more surfaces of a target object as a coating on the target object.

26 Claims, 13 Drawing Sheets

(51) Int. Cl.

| | |
|---|---|
| ***B05B 7/14*** | (2006.01) |
| ***B05B 13/02*** | (2006.01) |
| ***B05D 1/02*** | (2006.01) |
| ***B05B 12/00*** | (2018.01) |
| ***B05B 7/00*** | (2006.01) |
| ***B05B 7/16*** | (2006.01) |
| ***B05B 7/04*** | (2006.01) |
| ***F01D 25/28*** | (2006.01) |
| ***B05B 7/08*** | (2006.01) |
| ***C23C 24/04*** | (2006.01) |
| ***B05C 7/02*** | (2006.01) |
| ***B05C 19/00*** | (2006.01) |
| ***B05C 5/02*** | (2006.01) |
| ***F01D 5/00*** | (2006.01) |
| ***F01D 5/28*** | (2006.01) |

(52) U.S. Cl.

CPC ..... *B05B 7/0012* (2013.01); *B05B 7/045* (2013.01); *B05B 7/0884* (2013.01); *B05B 7/1436* (2013.01); *B05B 7/1481* (2013.01); *B05B 7/1673* (2013.01); *B05B 12/00* (2013.01); *B05B 13/0228* (2013.01); *B05C 5/0291* (2013.01); *B05C 7/02* (2013.01); *B05C 19/007* (2013.01); *B05D 1/02* (2013.01); *C23C 24/04* (2013.01); *F01D 25/285* (2013.01); *B05B 7/1686* (2013.01); *F01D 5/005* (2013.01); *F01D 5/288* (2013.01); *F05D 2230/90* (2013.01); *F05D 2240/128* (2013.01)

(58) Field of Classification Search

CPC ..... B05C 19/04; B05C 19/008; B05C 19/007; B05B 13/0627; B05B 13/0228; B05B 1/044; B05B 12/00; B05B 7/1436; B05B 7/1481; F05D 2240/128; F05D 2230/90; F05D 2230/30; B05D 1/02; F01D 5/005; Y10S 118/10; B08B 9/02; B08B 9/027; B08B 9/032; B08B 9/0433; B08B 9/0321; B08B 2209/027; B08B 2209/032; C23C 24/04

USPC ..... 118/313, 315, 317, 318, 320, 308; 427/231, 233, 236

See application file for complete search history.

(56) References Cited

U.S. PATENT DOCUMENTS

| | | | | |
|---|---|---|---|---|
| 4,893,752 | A * | 1/1990 | Spink | B05B 7/0458 239/427.3 |
| 4,950,497 | A | 8/1990 | Gillette et al. | |
| 5,041,301 | A | 8/1991 | Gillette et al. | |
| 5,484,107 | A * | 1/1996 | Holmes | B05B 7/0408 239/427.5 |
| 6,010,077 | A | 1/2000 | Casey | |
| 6,010,746 | A | 1/2000 | Descoteaux et al. | |
| 6,021,635 | A * | 2/2000 | Gaag | F23R 3/36 239/400 |
| 7,509,735 | B2 | 3/2009 | Philip et al. | |
| 8,221,825 | B2 | 7/2012 | Reitz et al. | |
| 8,356,482 | B2 | 1/2013 | Duval et al. | |
| 8,758,502 | B2 | 6/2014 | Neinburg et al. | |
| 9,096,763 | B2 | 8/2015 | Belov et al. | |
| 9,403,244 | B2 * | 8/2016 | Rautenberg | B23P 6/002 |
| 9,421,508 | B2 | 8/2016 | Bedetti | |
| 9,494,050 | B2 * | 11/2016 | Schnoebelen | F01D 25/02 |
| 2005/0235493 | A1 * | 10/2005 | Philip | C23C 4/02 29/889.1 |
| 2006/0040048 | A1 | 2/2006 | Han et al. | |
| 2007/0063072 | A1 | 3/2007 | Ganan Calvo et al. | |
| 2010/0178428 | A1 * | 7/2010 | Vermeire | B05B 1/3442 427/427.4 |
| 2011/0192910 | A1 | 8/2011 | Bedetti | |
| 2013/0134232 | A1 * | 5/2013 | Wang | C10J 3/50 239/9 |
| 2013/0174869 | A1 * | 7/2013 | Rosing | B08B 7/0021 134/7 |
| 2014/0180283 | A1 | 6/2014 | Morgan et al. | |
| 2015/0174544 | A1 | 6/2015 | Bedetti | |
| 2017/0218763 | A1 | 8/2017 | Diwinsky et al. | |
| 2018/0154381 | A1 | 6/2018 | Bewlay et al. | |

OTHER PUBLICATIONS

European Search Report dated Apr. 1, 2019 for corresponding European Application No. EP 18 20 5632 (2 pages).

European Search Opinion dated Apr. 1, 2019 for corresponding European Application No. EP 18 205 632.5 (3 pages).

* cited by examiner

SPRAY NOZZLE DEVICE FOR DELIVERING A RESTORATIVE COATING THROUGH A HOLE IN A CASE OF A TURBINE ENGINE

FIELD

The subject matter described herein relates to devices and systems used to apply or restore coatings inside machines, such as turbine blades or other components of turbine engines.

BACKGROUND

Many types of machines have protective coatings applied to interior components of the machines. For example, turbine engines may have thermal barrier coatings (TBC) applied to blades, nozzles, and the like, on the inside of the engines. These coatings can deteriorate over time due to environmental conditions in which the engines operate, wear and tear on the coatings, etc. Unchecked deterioration of the coatings can lead to significant damage to the interior components of the engines.

The outer casings or housings of turbine engines usually do not provide large access openings to the interior of the casings or housings. Because these coatings may be on the surfaces of components on the inside of the engines, restoring these coatings can require disassembly of the engines to reach the coatings. Disassembly of the engines can involve significant expense and time, and can result in systems relying on the engines (e.g., stationary power stations, aircraft, etc.) being out of service for a long time.

Some spray devices that restore coatings can be inserted into the small openings in the casings or housings without disassembling the engines, but these spray devices usually operate by moving the spray devices or components in the spray devices in order to apply the different components of the coatings. This movement can be difficult to control and can make it very difficult to apply an even, uniform restorative coating on interior surfaces of the engines.

BRIEF DESCRIPTION

In one embodiment, an atomizing spray nozzle device includes plural inlets disposed at a first end of the device along a center axis of the device. The inlets are configured to receive different phases of materials used to form a coating. The device also includes atomizing zone housing portion fluidly coupled with the inlets and disposed along the center axis of the device. The atomizing zone housing is configured to receive the different phases of the materials from the inlets. The atomizing zone housing is shaped to mix the different phases of the materials into a mixed phase slurry. The device also includes a plenum housing portion fluidly coupled with the atomizing housing portion along the center axis of the device. The plenum housing portion includes an interior plenum that is elongated along the center axis of the device. The plenum is configured to receive the mixed phase slurry from the atomizing zone. The device also includes one or more delivery nozzles fluidly coupled with the plenum. The one or more delivery nozzles provide one or more outlets from which the mixed phase slurry is delivered onto one or more surfaces of a target object as a coating on the target object.

In one embodiment, a system includes the atomizing spray nozzle device and an equipment controller configured to control rotation of a turbine engine into which the atomizing spray nozzle device is inserted during spraying of the mixed phase slurry by the atomizing spray nozzle device into the turbine engine.

In one embodiment, a system includes the atomizing spray nozzle device and a spray controller configured to control one or more of a pressure of the slurry provided to the atomizing spray nozzle device, a pressure of a gas provided to the atomizing spray nozzle device, a flow rate of the slurry provided to the atomizing spray nozzle device, a flow rate of the gas provided to the atomizing spray nozzle device, a temporal duration at which the slurry is provided to the atomizing spray nozzle device, a temporal duration at which the gas is provided to the atomizing spray nozzle device, a time at which the slurry is provided to the atomizing spray nozzle device, and/or a time at which the gas provided to the atomizing spray nozzle device.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
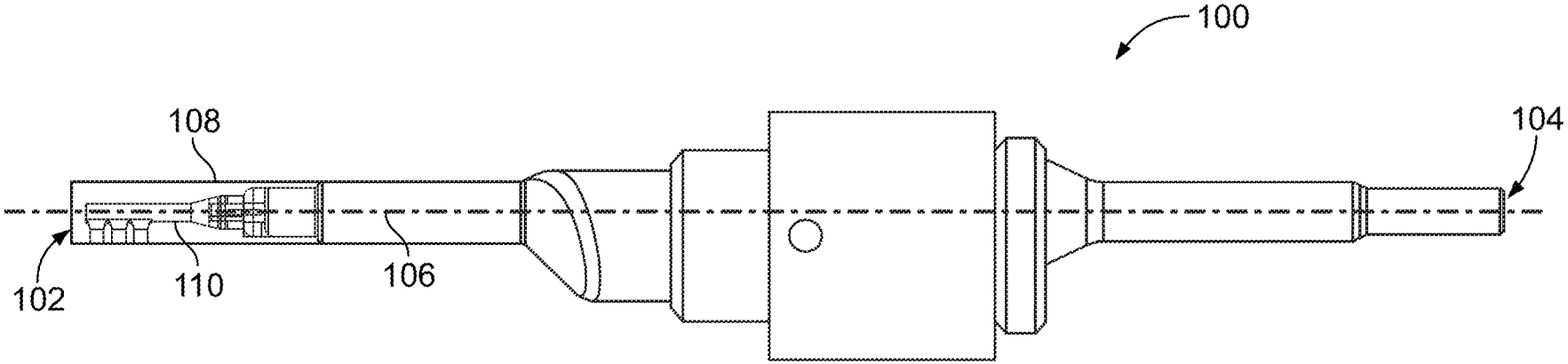
FIG. 1 illustrates one embodiment of a spray access tool.

One or more embodiments of the inventive subject matter described herein provide novel access tools and atomizing spray devices for producing a restorative coating for a turbine engine. The spraying access tool and spray nozzle devices possess unique and novel features that provide a restoration coating within a turbine engine without disassembly of the turbine engine. The spraying access tool, fluid delivery system, and spray nozzle devices can be employed through an access port in a turbine engine, such as a borescope port. The plugs for borescope parts can be easily removed and replaced with relatively little disruption to the operation of the turbine engine. A spray system includes a spray nozzle device for applying a restoration coating of, for example, a thermal barrier coating. While the description herein focuses on use of the spray system, access tool, and nozzle devices to apply restorative coatings on interior surfaces of turbine engines, the system, tool, and/or devices can be used to apply other, different coatings on interior or other surfaces of turbine engines, and/or can be used to apply coatings onto other surfaces of other machines. Unless specifically limited to turbine engines, thermal barrier coatings, or interior surfaces of turbine engines, not all embodiments described and claimed herein are so limited.

One or more embodiments of the spray devices described herein can be used to apply a spray coating that provides a chemical barrier coating to improve the resistance of the coating to attack by compounds such as calcium-magnesium alumino silicate. The chemical barrier coating also may provide some thermal improvement because of the thermal resistance of the spray coating. The chemical barrier coating can be applied in the field, in the overhaul shop, or even as a treatment to new components. Optionally, other coatings could be applied with the spray system and nozzle devices described herein.

One or more embodiments of the spraying access tool and spray nozzle device are designed to be employed inside a turbine engine at a fixed location that is set by the design of the spray access tool, the feedthrough into the turbine engine, and a mounting system for locating and fixing the feedthrough on the turbine case. The turbine can be rotated (one or multiple shafts of the engine of the engine can be rotated) as the spray is delivered by the spray nozzle device to the rotating components that are being sprayed with restoration coating. The spray typically possesses particles of size of less than five microns (e.g., the largest outside dimension of any, all, or each of the particles along a linear direction is no greater than five microns). As a result of the coating restoration, the time between overhauls of the turbine engine can be extended.

One or more novel features of the spray nozzle system include the use of an internal atomizing zone within the spray nozzle device and the use of a plenum post atomizing in the spray nozzle device. The plenum is an internal, elongated chamber in the spray device. The plenum is elongated (e.g., is longer) in a direction that is along or parallel to an axial direction or axis of the spray device (e.g., the direction in which the spray device is longest). The plenum can provide a supply of two-phase ceramic-liquid droplets in a carrier gas to the exit nozzles from the plenum. The elongated plenum allows for delivery of droplets from the array of exit orifices that provides a spray with a broad footprint. The broad spray allows uniform coverage of a coating on a component.

The spraying access tool and the spray nozzle device for providing a coating restoration system and process can include multiple elements, such as a device to allow access to the turbine engine, and a system for controlled rotation of the turbine engine at less than a slow designated speed, such as no faster than one hundred revolutions per minute. This can provide a system for full circumferential coating of the components that are being restored. The spray nozzle device can atomize a slurry and coat the thermal barrier coating on the component using this slurry that is atomized within the spray nozzle device. A control system and a process can deliver slurry to the atomizing nozzles within the spray nozzle device. The system can control slurry and gas delivery pressure, flow rate, delivery duration, and delivery time within a full spray coating program. The system can allow for a whole spectrum of options in terms of coating generation.

A spray and coating process can include selecting a nozzle spray angle, spray width, spray rates, spray duration, the number of passes over the targeted component surface, and/or the suitability of a component for coating based on the condition of the coating being restored. An engine start-up procedure can be used to cure the restoration coating. For example, the engine having the restored coating can be turned on, which generates heat that cures or speeds curing of the restored coating. Alternatively, a heating source can be introduced into the engine to affect local curing of the restoration coating. The curing device could also be employed with an element of engine rotation. For example, the engine can be rotated to speed up curing of the restored coating.

The spraying access tool and spray nozzle device have no moving components outside or inside the turbine engine during spraying of the restorative coating in one embodiment. Previous approaches use a spray nozzle that is moved over the surface on which coating deposition is being performed. The nozzle device employs no moving components inside the engine in one embodiment. This avoids parts being dropped or lost inside the engine during a coating procedure, and can provide for a more uniform coating.

The spray nozzle device can be configured to spray a full rotating blade set over the full three hundred sixty degrees of rotation of the blade around the shaft of the turbine engine with little to no blind spots or uncoated regions.

A control system can be used to supply slurry to the feedthrough and nozzle system to provide the restoration coating around the full annular area of the turbine engine. The ceramic slurry can be delivered to the nozzle system using individual tubes, coaxial tubes, or the like.

Different turbine architectures may require different nozzle devices and spray system designs. The feed through into the turbine engines for the nozzle device and spray system can be produced in a variety of manners, including three-dimensional or additive printing, which is rapid, relatively low cost, and well suited for this technology.

FIG. 1 illustrates one embodiment of a spray access tool 100. The spray access tool 100 can be included in a spraying system described herein. The spray access tool 100 is elongated from an insertion end 102 to an opposite distal end 104 along a center axis 106. The insertion end 102 is inserted into one or more openings into machinery in which the coating is to be applied (e.g., into the outer casing or housing of a turbine engine). The insertion end 102 includes an outer housing or casing 108 that extends around and at least partially encloses an atomizing spray nozzle device 110. The nozzle device 110 sprays an atomized, multiple phase slurry onto the interior surfaces of the machinery. The distal end 104 of the access tool 100 is fluidly coupled with one or more conduits of the spraying system for receiving the multiple, different phase materials that are atomized and mixed within the spray nozzle device 110.

In one embodiment, the atomizing spray nozzle device 110 applies the restoration coating using two fluid streams, a slurry of ceramic particles in a first fluid (such as alcohol or water) and a second fluid (e.g., a gas such as air, nitrogen, argon, etc.) to produce two-phase droplets of the ceramic particles within the fluid. The ceramic particles produce the restorative coating when the ceramic particles impact the component. The two-phase droplets are directed toward the region of the component that requires restoration after field exposure. The fluid temperature and component substrate are selected to affect evaporation of the fluid during the flight from the atomizing spray nozzle device 110 to the substrate or component surface such that the deposit consists largely of only ceramic particles, and minimal or little fluid and gas. While prior spraying solutions use a spray nozzle that is moved over the surface on which deposition is being performed, the access tool 100 and spray nozzle device 110 are not moved (e.g., relative to the outer casing or housing of the turbine engine) during spraying. In one embodiment, the spray nozzle device 110 can apply the restorative coating without cleaning the thermal barrier coating before application of the restorative coating.

Figure 2:
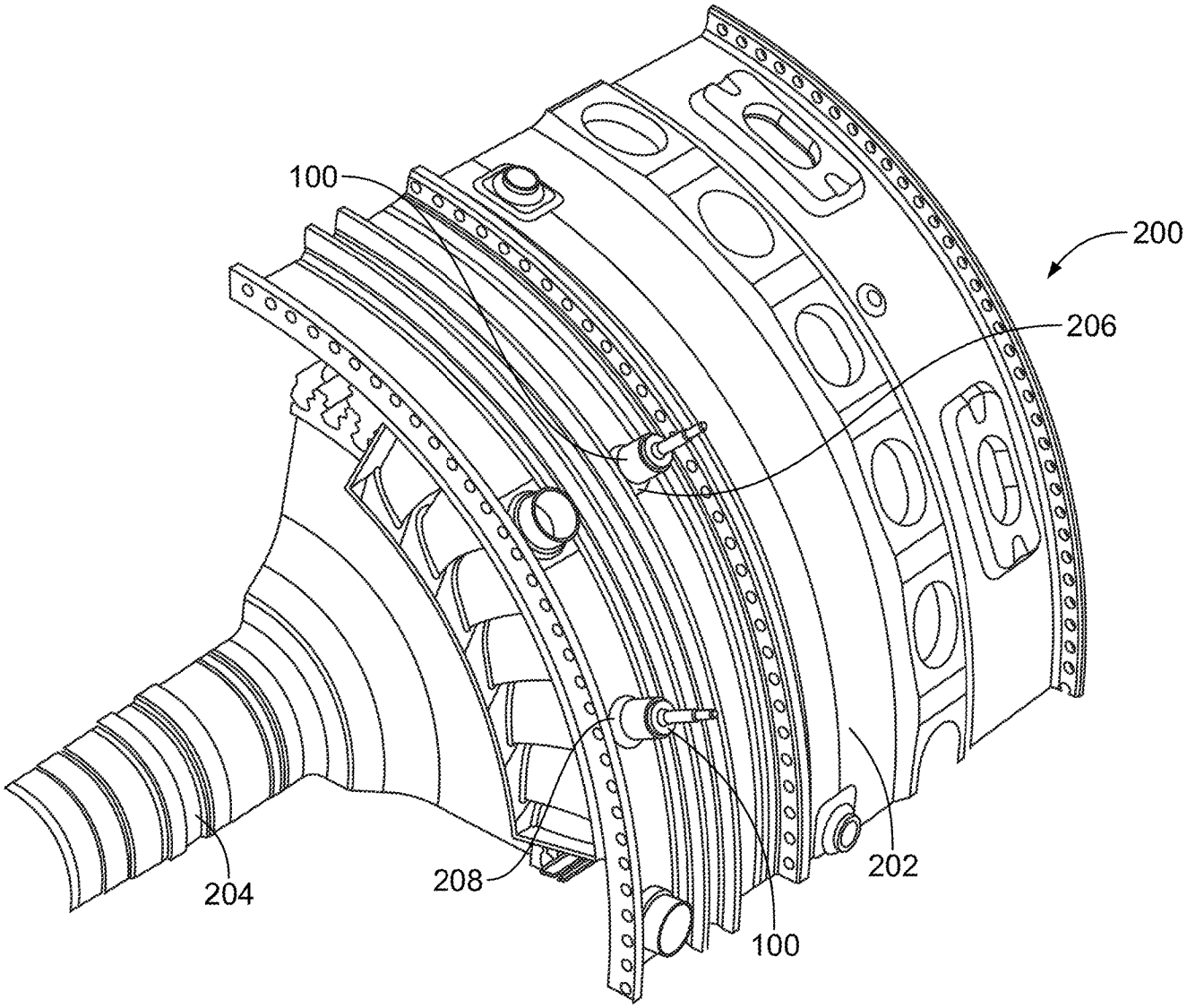
FIG. 2 illustrates a cut-away view of one embodiment of a machine in which the access tool shown in FIG. 1 is inserted to spray the coating on interior components of the machine.
Figure 3:
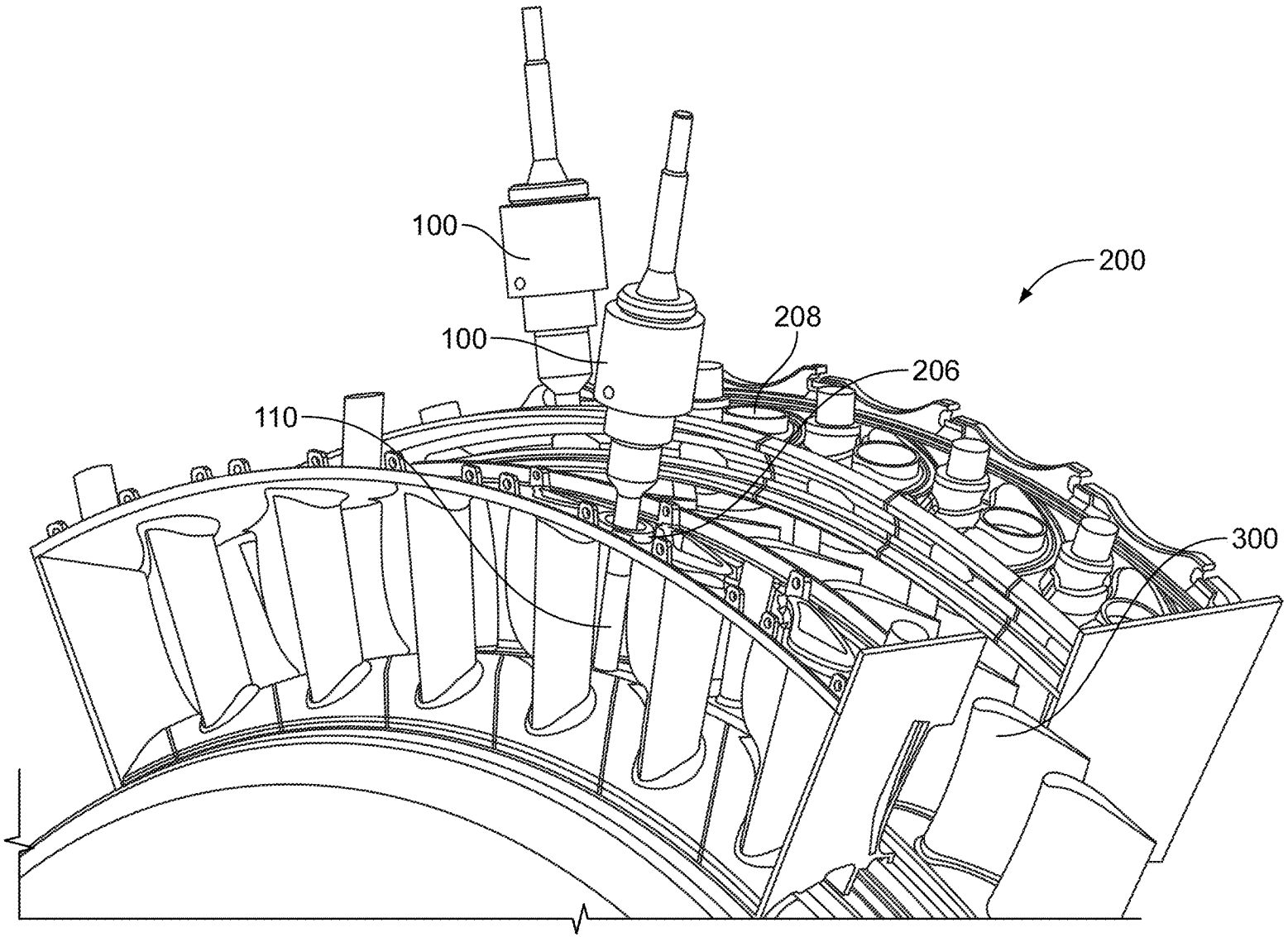
FIG. 3 illustrates a cross-sectional view of the machine shown in FIG. 2.
Figure 4:
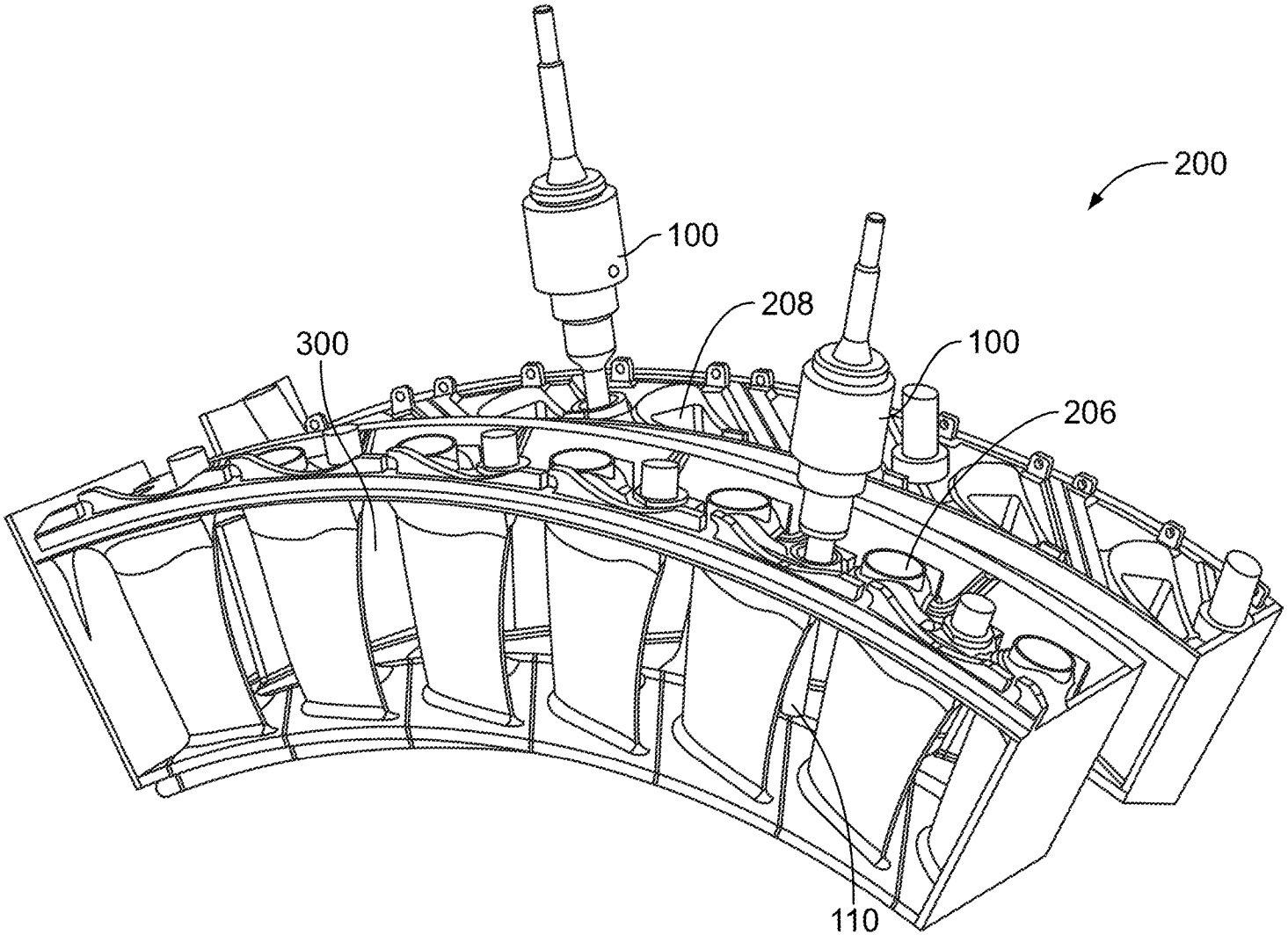
FIG. 4 illustrates another cross-sectional view of the machine shown in FIG. 2.

FIG. 2 illustrates a cut-away view of one embodiment of a machine 200 in which the access tool 100 is inserted to spray the coating on interior components of the machine 200. FIG. 3 illustrates a cross-sectional view of the machine 200 shown in FIG. 2. FIG. 4 illustrates another cross-sectional view of the machine 200 shown in FIG. 2. The machine 200 represents a turbine engine in the illustrated example, but optionally can be another type of machine or equipment. The machine 200 includes an outer housing or casing 202 that circumferentially extends around and encloses a rotatable shaft 204 having several turbine blades or fans 300 (shown in FIGS. 3 and 4) coupled thereto. The outer casing 202 includes several openings or ports 206, 208 that extend through the outer casing 202 and provide access into the interior of the outer casing 202. These ports 206, 208 can include stage one nozzle ports 206 and stage two nozzle ports 208 in the illustrated example, but optionally can include other openings or ports.

The access tool 100 is shaped to fit inside one or more of the ports 206, 208 such that the insertion end 102 of the access tool 100 (and the spray nozzle device 110) are disposed inside the machine 200, as shown in FIGS. 2 through 4. The opposite distal end 104 of the access tool 100 is located outside of the outer casing or housing 108 of the machine 200. During spraying of the restorative coating, the mixed phase materials used to form the coating are fed to the access tool 100 through the distal end 104 and flow into the spray nozzle device 110. The spray nozzle device 110 atomizes and mixes these materials into an airborne slurry that is sprayed onto components of the machine 200, such as the turbine blades 300. In one embodiment, the blades 300 can slowly rotate by the stationary spray nozzle device 110 during spraying of the restorative coating onto the blades 300. Alternatively, the restorative coating is sprayed onto the blades 300 or other surfaces inside the outer casing 202 of the machine 200 while the blades 300 or other surfaces remain stationary relative to the spray nozzle device 110.

The restorative coating on a thermal barrier coating can be applied to both surfaces of the turbine blade 300. The pressure side of the blade 300 can be coated using the spray access tool 100 and spray nozzle device 110 that is inserted into the stage one nozzle borescope port 206. The opposite suction side of the blade 300 can be coated using the same or another spraying access tool 100 and the same or another spray nozzle device 110 that is inserted through the stage two nozzle borescope port 208.

Figure 5:
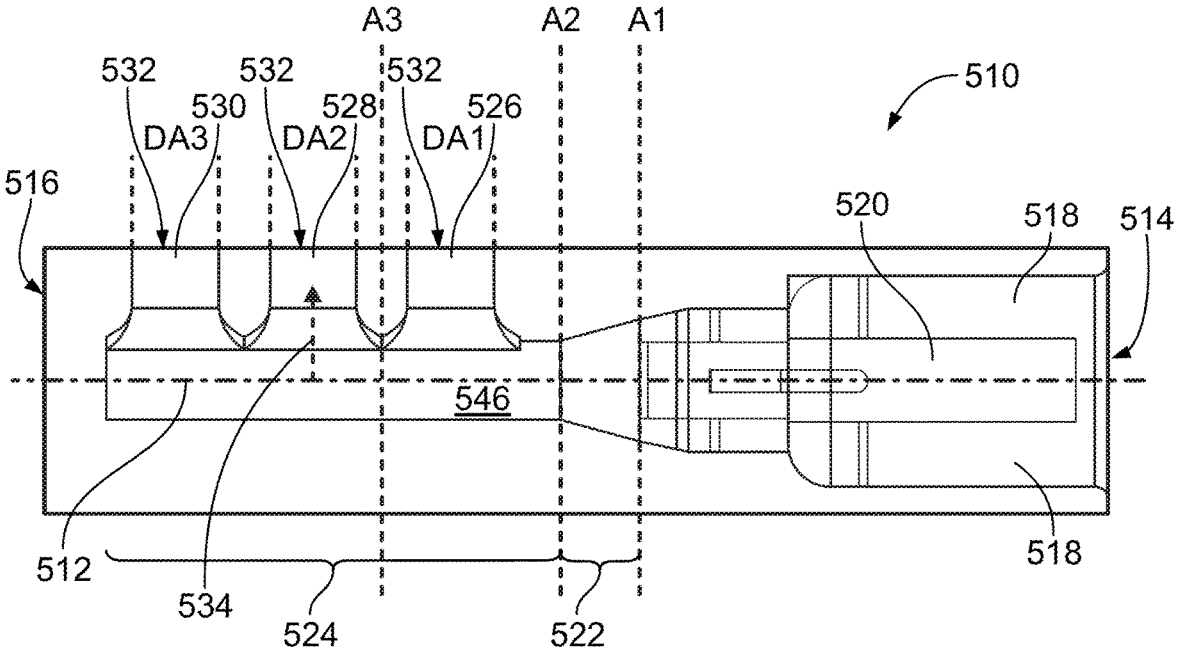
FIG. 5 illustrates a perspective view of one embodiment of an atomizing spray nozzle device.
Figure 6:
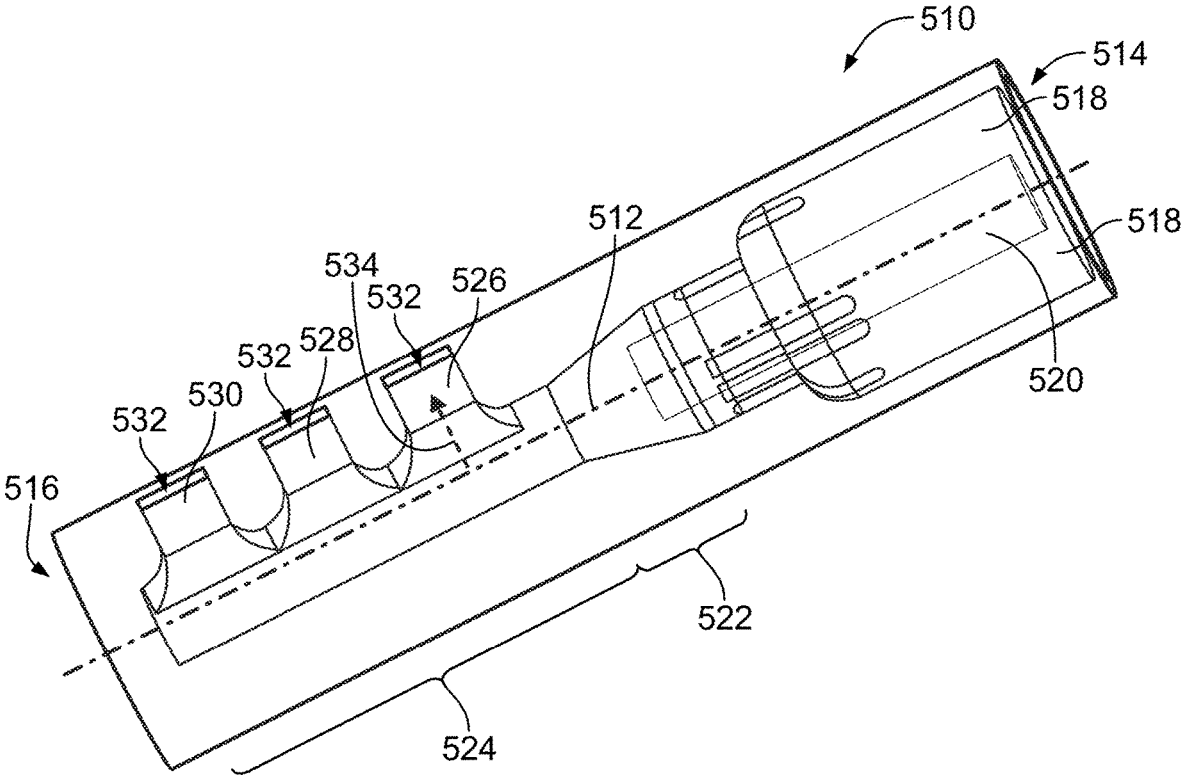
FIG. 6 illustrates a side view of the atomizing spray nozzle device shown in FIG. 5.

FIG. 5 illustrates a perspective view of one embodiment of an atomizing spray nozzle device 510. FIG. 6 illustrates a side view of the atomizing spray nozzle device 510 shown in FIG. 5. The spray nozzle device 510 can represent or be used in place of the spray nozzle device 110 shown in FIGS. 1 through 4. The spray nozzle device 510 is elongated along a center axis 512 from a feed end 514 to an opposite delivery end 516. The spray nozzle device 510 is formed from one or more housings that form an interior plenum chamber 546 extending between the feed end 514 and the delivery end 516. The interior plenum chamber 546 directs the flow of the materials forming the mixed phase slurry through and out of the spray nozzle device 510. As shown in FIG. 5, the plenum 546 is elongated in or along the center axis 512 (also referred to as an axial direction of the device 510). In the illustrated embodiment, the inlets 518, 520 are not directly coupled with the nozzles 526, 528, 530, but are coupled with the plenum 546, which is connected with the nozzles 526, 528, 530.

The housings of the spray nozzle device 510 and the other spray nozzle devices shown and described herein may have a cylindrical outer shape that is closed at one end (e.g., the delivery end) and that has inlets (as described below) at the opposite end (e.g., the feed end 514), with one or more internal chambers of different shapes formed inside the housing.

The spray nozzle device 510 includes several inlets 518, 520 extending from the feed end 514 toward (but not extending all the way to) the delivery end 516. These inlets 518, 520 receive different phases of the materials that are atomized within the spray nozzle device 510 to form the airborne slurry that is sprayed onto the surfaces of the machine 200. In the illustrated embodiment, one inlet 518 extends around, encircles, or circumferentially surrounds the other inlet 520. The inlet 518 can be referred to as the outer inlet and the inlet 520 can be referred to as the inner inlet. Alternatively, the inlets 518, 520 may be disposed side-by-side or in another spatial relationship. While only two inlets 518, 520 are shown, more than two inlets can be provided.

The inlets 518, 520 may each be separately fluidly coupled with different conduits of a spraying system that supplies the different phases of materials to the spray nozzle device 510. These conduits can extend through or be coupled with separate conduits in the access tool 100 that are separately coupled with the different inlets 518, 520. This keeps the different phase materials separate from each other until the materials are combined and atomized inside the spray nozzle device 510.

The spray nozzle device 510 includes an atomizing zone housing 522 that is fluidly coupled with the inlets 518, 520. The atomizing zone housing 522 includes an outer housing that extends from the inlets 518, 520 toward, but not all the way to, the delivery end 516 of the spray nozzle device 510. The atomizing zone housing 522 defines an interior chamber in the spray nozzle device 510 into which the different phase materials in the inlets 518, 520 are delivered from the inlets 518, 520. For example, slurry formed from liquid and ceramic particles can be fed into the atomizing zone housing 522 from the inner inlet 520 and a gas (e.g., air) can be fed into the atomizing zone housing 522 from the outer inlet 518.

The ceramic particles in the slurry are atomized during mixing with the gas in the atomizing zone housing 522 to form a mixed-phase slurry. This mixed-phase slurry flows out of the atomizing zone housing 522 into a plenum housing portion 524 of the spray nozzle device 510.

The plenum housing portion 524 is another part of the housing of the spray nozzle device 510 that is fluidly coupled with the atomizing zone housing 522. The plenum housing portion 524 extends from the atomizing zone housing 522 to the delivery end 516 of the spray nozzle device 510, and includes the plenum 546. The plenum housing portion 524 receives the mixed phase slurry from the atomizing zone housing 522.

The annular inlet 518 delivers gas to the atomizing zone housing 522. The two-phase fluid, or slurry, of ceramic particles and liquid is delivered through the central inlet or tube 520 to the atomizing zone housing 522. Two-phase droplets of ceramic particles and liquid are generated in the atomizing zone housing 522 and the atomizing gas accelerates the two-phase droplets from the atomizing zone housing 522 to the manifold or plenum housing portion 524. In one embodiment, atomizing is complete before the droplets enter the plenum housing portion 524.

One or more delivery nozzles are fluidly coupled with the plenum housing portion 524. In the illustrated embodiment, the spray nozzle device 510 includes three nozzles 526, 528, 530, although a single nozzle or a different number of two or more nozzles may be provided instead. The delivery nozzle 526 can be referred to as an upstream delivery nozzle as the delivery nozzle 526 is upstream of the nozzles 528, 530 along a flow direction of the materials in the spray nozzle device 510 (e.g., the direction in which these materials flow along the center axis 512 of the spray nozzle device 510). The delivery nozzle 530 can be referred to as a downstream delivery nozzle as the delivery nozzle 530 is downstream of the delivery nozzles 526, 528 along the flow direction. The delivery nozzle 528 can be referred to as an intermediate delivery nozzle as the delivery nozzle 528 is between the delivery nozzles 526, 530 along the flow direction.

In the illustrated embodiment, the delivery nozzles 526, 528, 530 are formed as tapered rectangular bodies that extend away from the outer surface of the spray delivery nozzle 510 in radial directions away from the center axis 512. The delivery nozzles 526, 528, 530 include rectangular openings 532 that are all elongated along the same direction that also is parallel to and extends along the center axis 512. Optionally, the delivery nozzles 526, 528, 530 may have other shapes, may have different sized openings, and/or may not be aligned with each other as shown in FIGS. 5 and 6.

The openings 532 of the nozzles 526, 528, 530 provide outlets through which the mixed phase slurry is delivered from the plenum housing portion 524 onto one or more surfaces of the target object of the machine 200 as a coating or restorative coating on the machine 200. The nozzles 526, 528, 530 can deliver the mixed phase slurry at pressures of ten to three hundred pounds per square inch and, in one embodiment, as a pressure of less than one hundred pounds per square inch for both the slurry delivery and the gas delivery.

As shown in FIGS. 5 and 6, the openings 532 in the nozzles 526, 528, 530 are oriented or positioned to direct the spray of the mixed-phase slurry in radial directions 534 that radially extend away from the center axis 512 of the spray nozzle device 510 and/or in directions that are more aligned with the radial directions 534 than directions that are perpendicular to the radial directions 534 (e.g., these other directions are closer to being parallel than perpendicular to the radial directions 534).

In one embodiment, the nozzles 526, 528, 530 are small such that the nozzles 526, 528, 530 further atomize the mixed-phase slurry. The gas moving through the delivery spray device 510 can carry the mixed-phase slurry out of the nozzles 526, 528, 530 toward the surfaces onto which the restorative coating is being formed by the mixed-phase slurry.

The spray nozzle device 510 is designed to provide a conduit for at least two fluid media. The first fluid is a two-phase mixture, or slurry, of ceramic particles in a liquid, such as yttria stabilized zirconia particles in alcohol. The particles are typically less than ten microns in size, and can be as small as less than 0.5 microns in size. The second fluid is an atomizing gas that generates a spray by disintegrating the two-phase mixture of ceramic particles in a liquid into two-phase droplets of the same liquid (such as alcohol) and ceramic particles. The conduit of the nozzle spray device 510 is designed such that little to no evaporation of the fluid occurs during the transfer such that the composition of the two-phase ceramic particle-liquid medium is preserved to the region of atomizing in the nozzles 526, 528, 530 and the generation of the two-phase droplets of the ceramic slurry, such as alcohol and yttria stabilized zirconia particles. The droplets are created within the spray nozzle device 510 prior to delivery of the materials onto the part being coated. The openings 532 of the delivery nozzles 526, 528, 530 operate to direct the spray and control the spray angle and width, and thereby provide a uniform coating.

Several cross-sectional planes through the spray nozzle device 510 are labeled in FIG. 5. The delivery nozzle device 510 has a tapered shape that decreases in cross-sectional area in the atomizing zone housing 522 from a larger cross-sectional area at the interface between the atomizing zone housing 522 (e.g., the cross-sectional plane labeled A1 in FIG. 5) to a smaller cross-sectional area at the interface between the atomizing zone housing 522 and the plenum housing portion 524 (e.g., the cross-sectional plane labeled A2 in FIG. 5). The cross-sectional area of the spray nozzle device 510 remains the same from the cross-sectional plane A2 to any cross-sectional plane located between or downstream of any of the delivery nozzles 526, 528, 530 (e.g., one of these cross-sectional planes is labeled A3 in FIG. 5).

The delivery nozzles 526, 528, 530 may have the same cross-sectional areas DA1, DA2, DA3 in any plane that is parallel to the center axis 512 of the spray nozzle device 510. The cross-section areas DA1, DA2, DA3 of the nozzles 52, 528, 530 operates as the metering orifice area in the fluid circuit of the spray nozzle device 510. In one embodiment, the sum of the cross-section areas DA1, DA2, DA3 of the delivery nozzles 526, 528, 530 is less than, equal to, or approximately equal to (e.g., within 1%, within 3%, or within 5% of) the cross-sectional area A1 of the interface between the outer inlet 518 and the atomizing zone housing 522 (also referred to as the throat area of the delivery nozzle device 510). The inventors of the subject matter described herein have discovered that these relationships between the cross-sectional areas result in metering of the mixed-phase slurry through and out of the spray nozzle device 510 that applies the uniform coatings described herein.

The sizes and arrangements of the nozzles 526, 528, 530 provide a uniform thickness coating on the interior components of the machine 200 over a broader or wider area when compared with other known spray devices, without having any moving parts or components. For example, the mixed-phase slurry that is sprayed from the nozzles 526, 528, 530 can extend over a wide range of degrees inside the machine 200 while providing a restorative coating that does not vary by more than 1%, more than 3%, or more than 5% in thickness. As described above, the spray nozzle device 510 may not have moving components and may not move relative to the outer casing 202 of the machine 200 during spraying of the coating, but the blades 300 of the machine 200 may slowly rotate during spraying so that multiple blades 300 can be covered by the restorative coating sprayed by the spray nozzle device 510.

Figure 23:
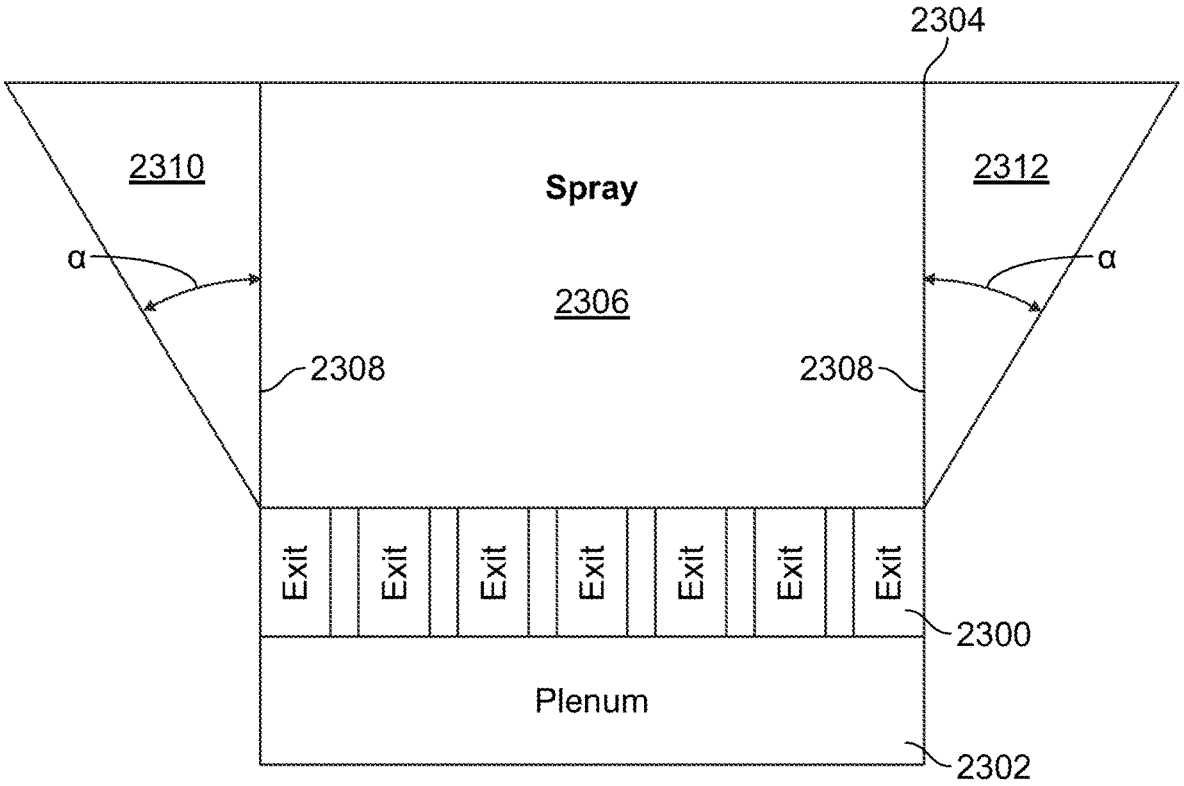
FIG. 23 schematically illustrates spraying of the coating by several nozzles of a spray device according to one example.

FIG. 23 schematically illustrates spraying of the coating by several nozzles 2300 of a spray device according to one example. The nozzles 2300 can represent one or more of the nozzles described herein. The nozzles 2300 are fluidly coupled with a plenum chamber 2302, which can represent one or more of the plenum chambers described herein. The nozzles 2300 and plenum chamber 2302 can represent the nozzles and/or plenum chambers in one or more of the spray devices described herein.

The nozzles 2300 direct the coating being sprayed over a very large area. In one embodiment, the nozzles 2300 spray the coating over an area 2304 that includes a rectangular sub-area 2306 that is bounded by linear paths 2308 extending away from the outermost edges of the outermost nozzles 2300 in radial directions from the center axis. The area 2304 also extends beyond the sub-area 2306 into two angled areas 2310, 2312. The angled areas 2310, 2312 extend outward from the sub-area 2306 by angles $\alpha$. The angles $\alpha$ can vary in size but, in at least one embodiment, the angles $\alpha$ are each at least fifteen degrees and no more than 35 degrees. The entire area 2304 defines a large area over which the spray device can apply a uniform coating without having to move the spray device.

Figure 7:
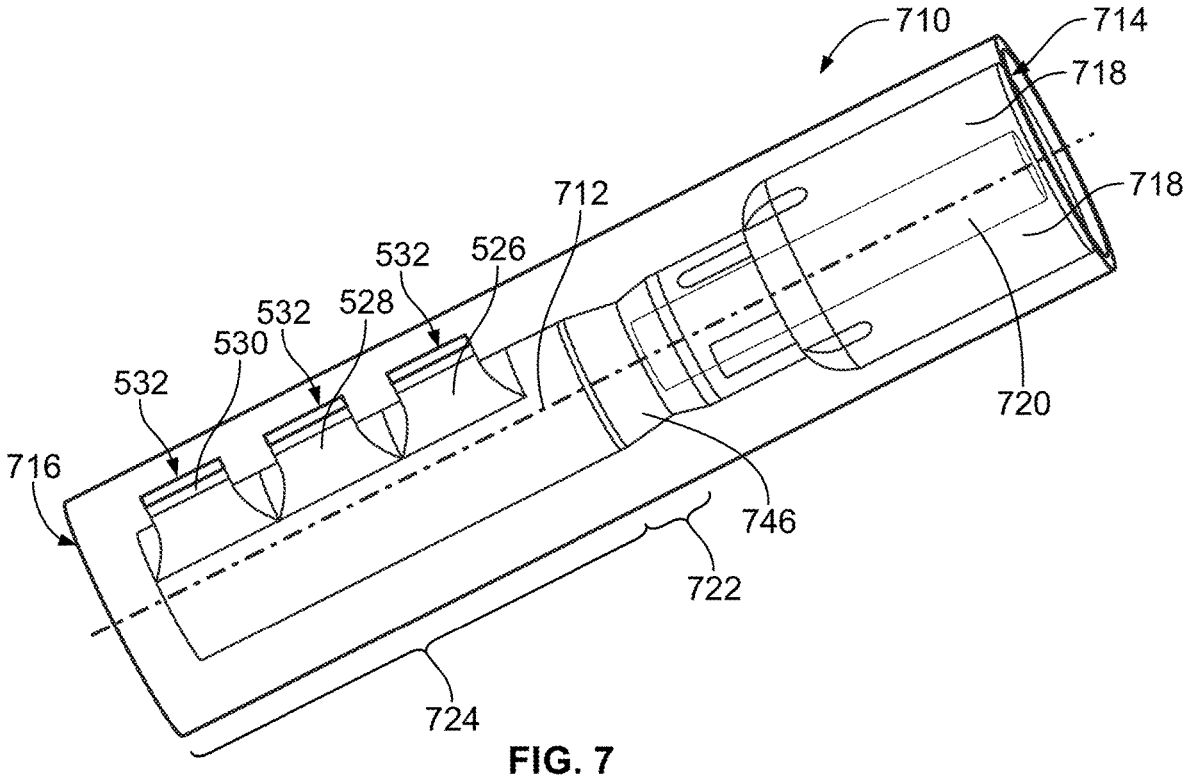
FIG. 7 illustrates a perspective view of one embodiment of an atomizing spray nozzle device.
Figure 8:
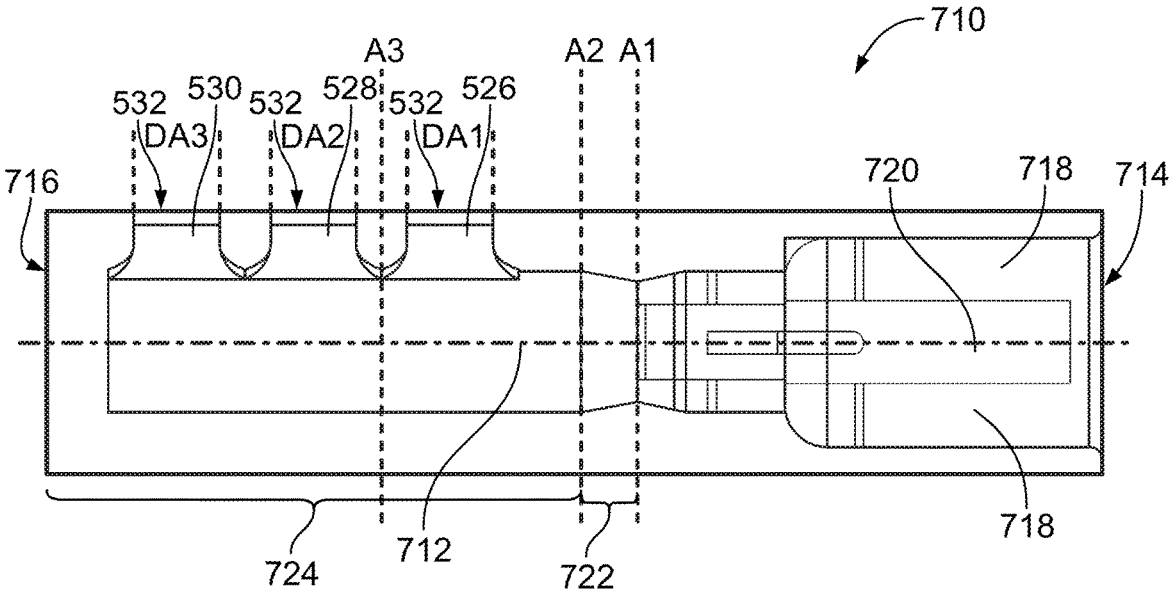
FIG. 8 illustrates a side view of the atomizing spray nozzle device shown in FIG. 7.

FIG. 7 illustrates a perspective view of one embodiment of an atomizing spray nozzle device 710. FIG. 8 illustrates a side view of the atomizing spray nozzle device 710 shown in FIG. 7. The spray nozzle device 710 can represent or be used in place of the spray nozzle device 110 shown in FIGS. 1 through 4. The spray nozzle device 710 is elongated along a center axis 712 from a feed end 714 to an opposite delivery end 716, and includes an interior plenum or chamber 746 through which materials flow in the device 710. The spray nozzle device 710 includes several inlets 718, 720 extending from the feed end 714 toward (but not extending all the way to) the delivery end 716. These inlets 718, 720 receive different phases of the materials that are atomized within the spray nozzle device 710 to form the airborne slurry that is sprayed onto the surfaces of the machine 200. In the illustrated embodiment, the inlet 718 is annular shaped and extends around, encircles, or circumferentially surrounds the other inlet 720, similar to the inlets 518, 520 described above. Alternatively, the inlets 718, 720 may be disposed side-by-side or in another spatial relationship. While only two inlets 718, 720 are shown, more than two inlets can be provided.

The inlets 718, 720 may each be separately fluidly coupled with different conduits of a spraying system that supplies the different phases of materials to the spray nozzle device 710, similar to the inlets 518, 520. The spray nozzle device 710 includes an atomizing zone housing 722 that is fluidly coupled with the inlets 718, 720. The atomizing zone housing 722 includes an outer housing that extends from the inlets 718, 720 toward, but not all the way to, the delivery end 716 of the spray nozzle device 710. The atomizing zone housing 722 defines an interior chamber in the spray nozzle device 710 into which the different phase materials in the inlets 718, 720 are delivered from the inlets 718, 720 and atomized, similar to as described above in connection with the atomizing zone housing 522 of the spray nozzle device 510.

A plenum housing portion 724 is another part of the housing of the spray nozzle device 710 that is fluidly coupled with the atomizing zone housing 722. The plenum housing portion 724 extends from the atomizing zone housing 722 to the delivery end 716 of the spray nozzle device 710, and includes the plenum 746. The plenum housing portion 724 receives the mixed phase slurry from the atomizing zone housing 722, similar to as described above in connection with the spray nozzle device 510. The plenum housing portion 724 is coupled with the delivery nozzles 526, 528, 530 that direct the mixed phase slurry and carrying gas toward the surfaces being coated, as described above. As shown in FIG. 7, the plenum 746 is elongated in or along the center axis 712. In the illustrated embodiment, the inlets 718, 720 are not directly coupled with the nozzles 726, 728, 730, but are coupled with the plenum 746, which is connected with the nozzles 726, 728, 730.

As shown in FIGS. 5 through 8, one manner in which the spray nozzle devices 510, 710 differ is the shape of the housings of the devices 510, 710 in the atomizing zone housings 522, 722. The interior chamber formed by the atomizing zone housing 522 in the device 510 is tapered along the flow direction in the device 510 such that the cross-sectional area of the atomizing zone housing 522 decreases at different locations along the center axis 512 in the feed direction (e.g., the housing 522 becomes narrower as the materials flow through the housing 522 toward the nozzles 526, 528, 530). Conversely, the interior chamber formed by the atomizing zone housing 722 in the device 710 is tapered in a direction that is opposite the flow direction in the device 710 such that the cross-sectional area of the atomizing zone housing 722 increases at different locations along the center axis 512 in the direction that is opposite to the feed direction (e.g., the housing 722 becomes wider or larger as the materials flow through the housing 722 toward the nozzles 526, 528, 530).

Several cross-sectional planes through the spray nozzle device 710 are labeled in FIG. 7. The delivery nozzle device 710 has a tapered shape that increases in cross-sectional area in the atomizing zone housing 722 from a smaller cross-sectional area at the interface between the atomizing zone housing 722 (e.g., the cross-sectional plane labeled A1 in FIG. 7) to a larger cross-sectional area at the interface between the atomizing zone housing 722 and the plenum housing portion 724 (e.g., the cross-sectional plane labeled A2 in FIG. 7). The cross-sectional area of the spray nozzle device 710 remains the same from the cross-sectional plane A2 to any cross-sectional plane located between or downstream of any of the delivery nozzles 526, 528, 530 (e.g., one of these cross-sectional planes is labeled A3 in FIG. 7).

The delivery nozzles 526, 528, 530 may have the same cross-sectional areas DA1, DA2, DA3 in any plane that is parallel to the center axis 712 of the spray nozzle device 710. The cross-section areas DA1, DA2, DA3 of the nozzles 52, 528, 530 operate as the metering orifice area in the fluid circuit of the spray nozzle device 710. In one embodiment, the sum of the cross-section areas DA1, DA2, DA3 of the delivery nozzles 526, 528, 530 is less than the cross-sectional area A1 of the interface between the outer inlet 718 and the atomizing zone housing 722 (also referred to as the throat area of the delivery nozzle device 710). The inventors of the subject matter described herein have discovered that these relationships between the cross-sectional areas result in metering of the mixed-phase slurry through and out of the spray nozzle device 710 that applies the uniform coatings described herein.

Figure 9:
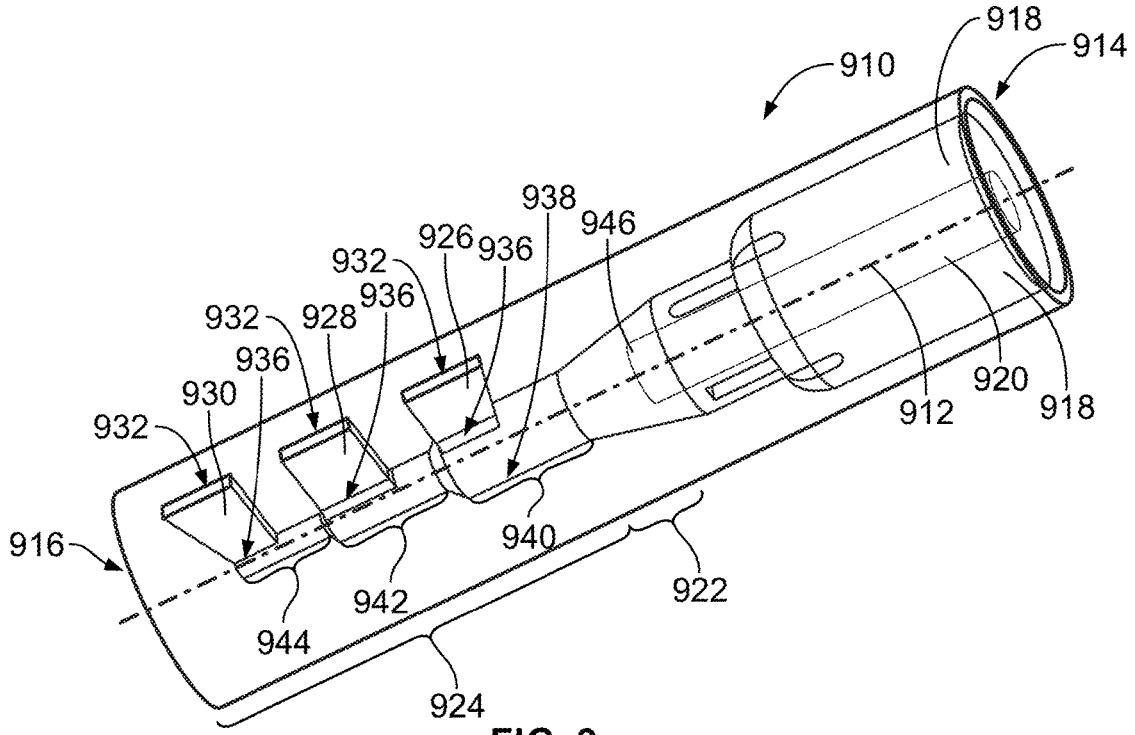
FIG. 9 illustrates a perspective view of one embodiment of an atomizing spray nozzle device.
Figure 10:
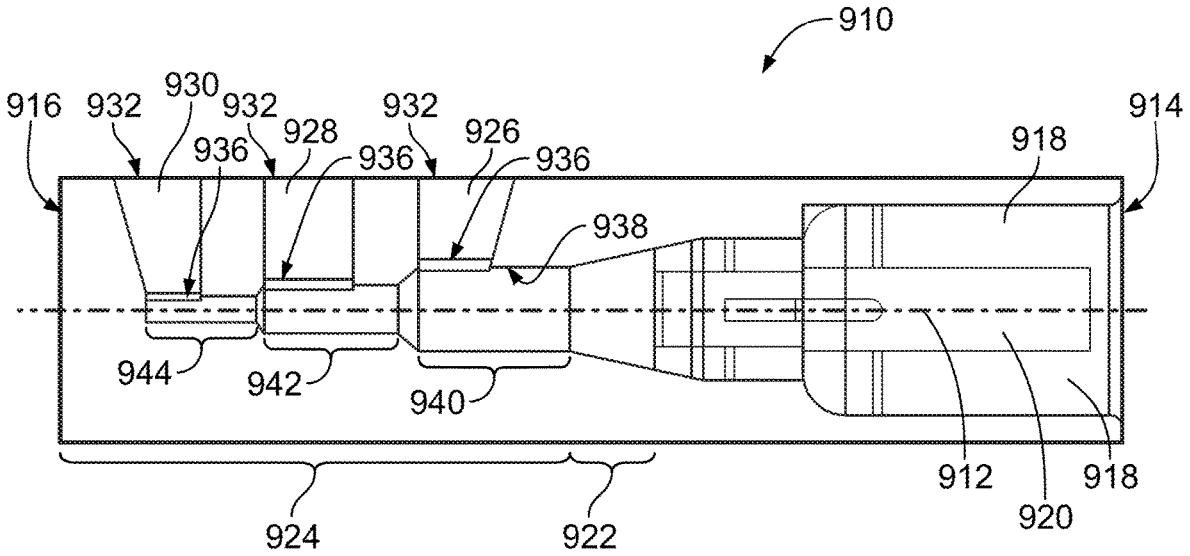
FIG. 10 illustrates a side view of the atomizing spray nozzle device shown in FIG. 9.
Figure 11:
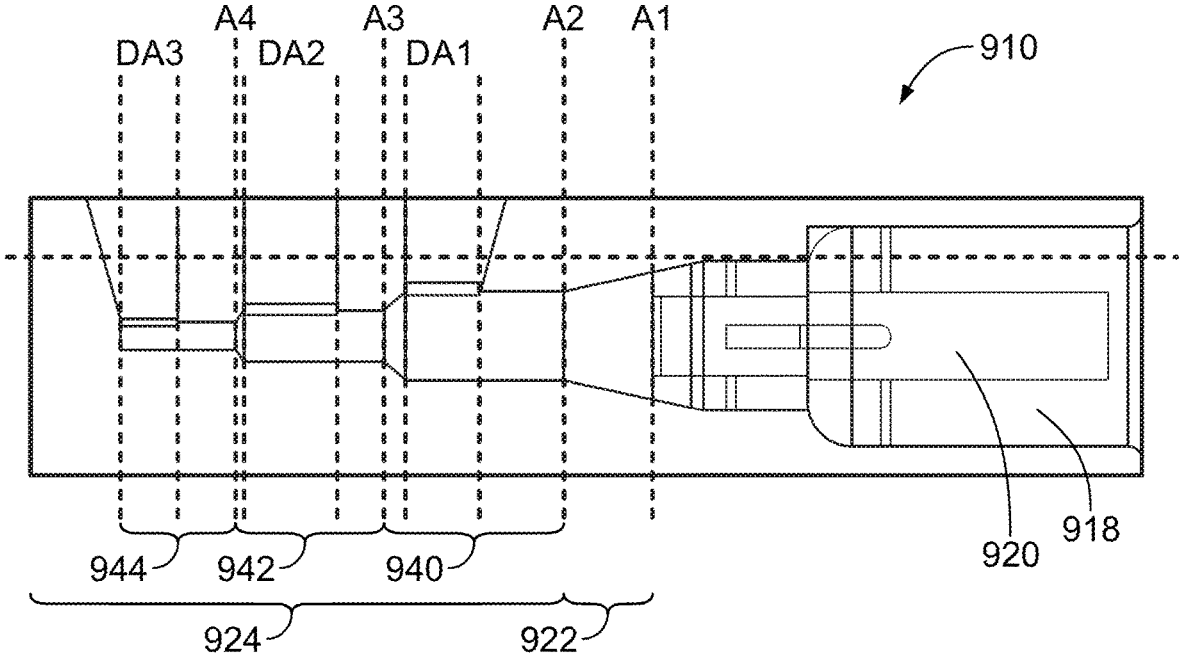
FIG. 11 illustrates another side view of the atomizing spray nozzle device shown in FIG. 9.

FIG. 9 illustrates a perspective view of one embodiment of an atomizing spray nozzle device 910. FIG. 10 illustrates a side view of the atomizing spray nozzle device 910 shown in FIG. 9. FIG. 11 illustrates another side view of the atomizing spray nozzle device 910 shown in FIG. 9 with several cross-sectional planes being labeled.

The spray nozzle device 910 can represent or be used in place of the spray nozzle device 110 shown in FIGS. 1 through 4. The spray nozzle device 910 is elongated along a center axis 912 from a feed end 914 to an opposite delivery end 916, and includes an interior chamber or plenum 946 through which materials flow in the device 910. The spray nozzle device 910 includes several inlets 918, 920 extending from the feed end 914 toward (but not extending all the way to) the delivery end 916. These inlets 918, 920 receive different phases of the materials that are atomized within the spray nozzle device 910 to form the airborne slurry that is sprayed onto the surfaces of the machine 200. In the illustrated embodiment, the inlet 918 is annular shaped and extends around, encircles, or circumferentially surrounds the other inlet 920, similar to the inlets 518, 520 described above. Alternatively, the inlets 918, 920 may be disposed side-by-side or in another spatial relationship. While only two inlets 918, 920 are shown, more than two inlets can be provided.

The inlets 918, 920 may each be separately fluidly coupled with different conduits of a spraying system that supplies the different phases of materials to the spray nozzle device 910, similar to the inlets 518, 520. The spray nozzle device 910 includes an atomizing zone housing 922 that is fluidly coupled with the inlets 918, 920. The atomizing zone housing 922 includes an outer housing that extends from the inlets 918, 920 toward, but not all the way to, the delivery end 916 of the spray nozzle device 910. The atomizing zone housing 922 defines an interior chamber in the spray nozzle device 910 into which the different phase materials in the inlets 918, 920 are delivered from the inlets 918, 920 and atomized, similar to as described above in connection with the atomizing zone housing 522 of the spray nozzle device 510.

A plenum housing portion 924 is another part of the housing of the spray nozzle device 910 that is fluidly coupled with the atomizing zone housing 922. The plenum housing portion 924 extends from the atomizing zone housing 922 to the delivery end 916 of the spray nozzle device 910, and includes the plenum 946. The plenum housing portion 924 receives the mixed phase slurry from the atomizing zone housing 922, similar to as described above in connection with the spray nozzle device 510. The plenum housing portion 924 is coupled with several delivery nozzles 926, 928, 930 that direct the mixed phase slurry and carrying gas toward the surfaces being coated, as described above. As shown in FIG. 9, the plenum 946 is elongated in or along the center axis 912. In the illustrated embodiment, the inlets 918, 920 are not directly coupled with the nozzles 926, 928, 930, but are coupled with the plenum 946, which is connected with the nozzles 926, 928, 930.

One way the spray nozzle device 910 differs from the spray nozzle devices 510, 710 is the shape of the nozzles 926, 928, 930 in the plenum housing portion 924. The nozzles 526, 528, 530 in the spray nozzle devices 510, 710 have non-tapered shapes in that the cross-sectional areas of the intersections between the nozzles 526, 528, 530 and the plenum housing portions 524, 724 in the spray nozzle devices 510, 710 are the same as the corresponding openings 532 of the nozzles 526, 528, 530. For example, the nozzles 526, 528, 530 may have the same size and/or shape on opposite ends of each nozzle 526, 528, 530. Conversely, one or more of the nozzles 926, 930 in the spray nozzle device 910 has a tapered shape in the illustrated embodiment. For example, the outer delivery nozzles 926, 930 (e.g., the upstream and downstream delivery nozzles 926, 930) are flared or otherwise tapered in or along radial directions 934 that radially extend away from the center axis 912. These nozzles 926, 930 may be flared or tapered in that the cross-sectional area of outer openings 932 at the outer ends of the nozzles 926, 930 are larger than internal openings 936 at intersections between the nozzles 926, 930 and the interior chamber defined by the plenum housing portion 924. The mixed phase slurry flows from the interior chamber defined by the plenum housing portion 924 into the delivery nozzles 926, 928, 930 through the internal openings 936. The mixed phase slurry flows out of the spray delivery device 910 through the outer openings 932, similar to how the slurry flows out of the spray delivery devices 510, 710 through the openings 532.

Another difference between the spray nozzle device 910 and one or more other spray nozzle devices disclosed herein is the shape of the plenum housing portion 924. An inner surface 938 of the plenum housing portion 924 defines the interior chamber in the plenum housing portion 924 through which the mixed phase slurry flows to the delivery nozzles 926, 928, 930. In contrast to this inner surface in the plenum housing portions 524, 724 of the spray devices 510, 710, the inner surface 938 in the plenum housing portion 924 of the spray device 910 is staged in cross-sectional area such that different segments of the plenum housing portion 924 have different cross-sectional areas. These segments can include an upstream segment 940, an intermediate segment 942, and a downstream segment 944. Optionally, there can be fewer or a greater number of segments.

Different delivery nozzles 926, 928, 930 can be fluidly coupled with different segments 940, 942, 944 of the plenum housing portion 924. For example, the upstream delivery nozzle 926 can be fluidly coupled with the upstream segment 940, the intermediate delivery nozzle 928 can be fluidly coupled with the intermediate segment 942, and the downstream delivery nozzle 930 can be fluidly coupled with the downstream segment 944.

In the illustrated embodiment, the segments 940, 942, 944 of the plenum housing portion 924 are staged in cross-sectional area such that the cross-sectional areas of the segments 940, 942, 944 decrease at different locations along the length of the center axis 912 in the flow direction of the spray nozzle device 910. For example, the cross-sectional area of the upstream segment 940 can be larger than the cross-sectional area of the intermediate segment 942 and can be larger than the cross-sectional area of the downstream segment 944. The cross-sectional area of the intermediate segment 942 can be larger than the cross-sectional are of the downstream segment 944.

Several cross-sectional areas of the spray delivery device 910 are labeled in FIG. 11 to avoid confusion with the other labeled items and reference numbers shown in FIG. 10. The cross-sectional area at the interface between the atomizing zone housing 922 and the inlets 918, 920 (labeled A1 in FIG. 11) is larger than the cross-sectional area at the interface between the atomizing zone housing 922 and the plenum housing portion 924 (labeled A2 in FIG. 11) in one embodiment. For example, the size of the atomizing zone housing 922 may be tapered along the flow direction similar to the atomizing zone housing 522 of the spray device 510 shown in FIGS. 5 and 6. The interior surface 938 of the plenum housing portion 924 includes several steps that define the different segments 940, 942, 944. Additional cross-sectional areas at different locations along the flow direction within these steps in the spray device 910 continue to decrease. For example, a cross-sectional area in the location labeled A2 (at a leading end of the upstream segment 940) can be larger than the cross-sectional area in the location labeled A3 (at a leading end of the intermediate segment 942) and can be larger than the cross-sectional area in the location labeled A4 (at a leading end of the downstream segment 944). The cross-sectional area in the location labeled A3 can be larger than the cross-sectional area in the location labeled A4.

The cross-sectional areas of the interior chamber defined by the plenum housing portion 924 on either side of the delivery nozzles 926, 928, 930 and the cross-sectional areas of the outer openings 932 of the nozzles 926, 928, 930 can be related. For example, the cross-sectional area of the interior chamber at the location labeled A3 can be equal to or approximately equal to the difference between the cross-sectional area of the interior chamber at the location labeled A2 and the cross-sectional area of the outer opening 932 of the upstream nozzle 926. The cross-sectional area of the interior chamber at the location labeled A4 can be equal to or approximately equal to the difference between the cross-sectional area of the interior chamber at the location labeled A3 and the cross-sectional area of the outer opening 932 of the intermediate nozzle 926. The sum of the cross-sectional areas of the outer openings 932 of the delivery nozzles 926, 928, 930 is no larger than the cross-sectional area of the interior chamber at the location labeled A2 in one embodiment.

The stepped cross-sectional areas of the interior chamber defined by the plenum housing portion 924 provides for more uniform pressure and delivery of droplets of the mixed phase slurry along the spray delivery device 910 as the delivery nozzle exit area increases with increasing length along the spray delivery device 910. One advantage of this design is that the design provides improved distribution of the ceramic particle-liquid droplets from the delivery nozzles 926, 928, 930 along the length of the spray nozzle device 910, and improved uniformity of the coating on the components inside the machine 200 relative to one or more other embodiments disclosed herein.

Figure 12:
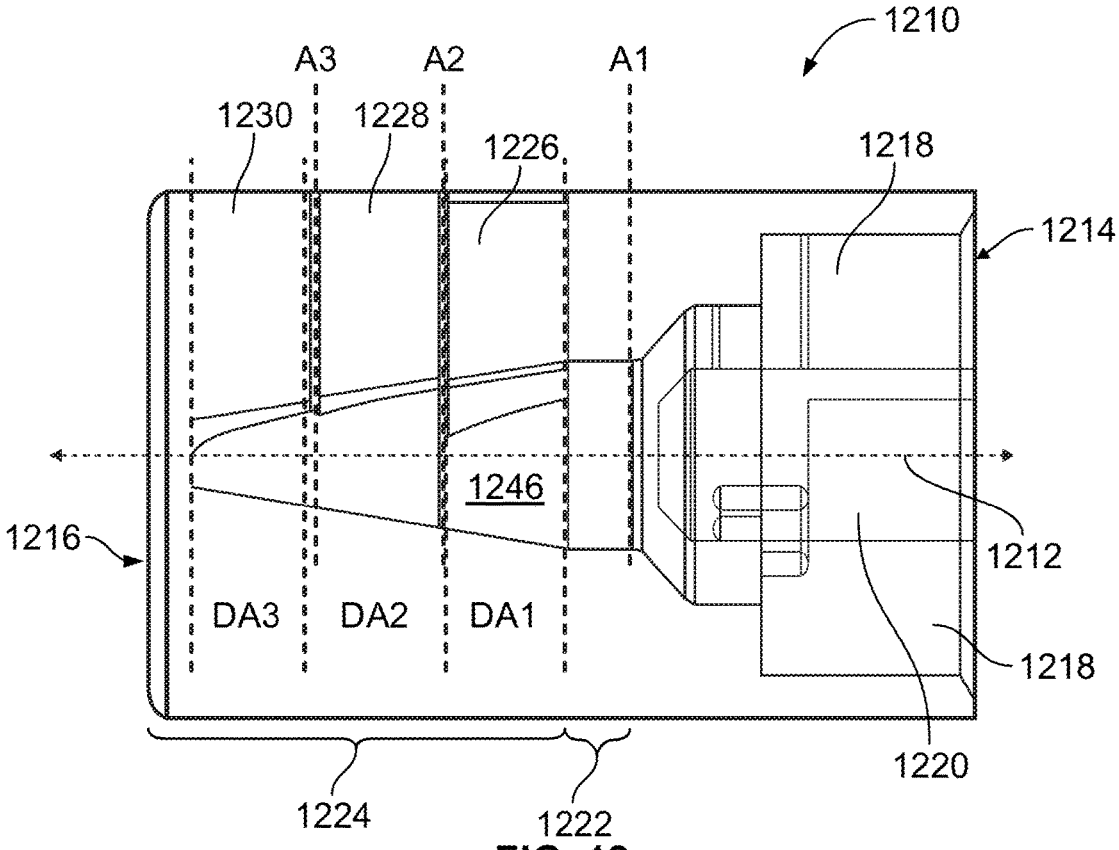
FIG. 12 illustrates a side view of one embodiment of an atomizing spray nozzle device.

FIG. 12 illustrates a side view of one embodiment of an atomizing spray nozzle device 1210. The spray nozzle device 1210 can represent or be used in place of the spray nozzle device 110 shown in FIGS. 1 through 4. The spray nozzle device 1210 is elongated along a center axis 1212 from a feed end 1214 to an opposite delivery end 1216, and includes an interior chamber or plenum 1246 through which materials flow in the device 1210. The spray nozzle device 1210 includes several inlets 1218, 1220 extending from the feed end 1214 toward (but not extending all the way to) the delivery end 1216. As described above, these inlets 1218, 1220 receive different phases of the materials that are atomized within the spray nozzle device 1210 to form the airborne slurry that is sprayed onto the surfaces of the machine 200. In the illustrated embodiment, the inlet 1218 is annular shaped and extends around, encircles, or circumferentially surrounds the other inlet 1220, similar to as described above. Alternatively, the inlets 1218, 1220 may be disposed side-by-side or in another spatial relationship. While only two inlets 1218, 1220 are shown, more than two inlets can be provided.

The spray nozzle device 1210 includes an atomizing zone housing 1222 that is fluidly coupled with the inlets 1218, 1220. The atomizing zone housing 1222 includes an outer housing that extends from the inlets 1218, 1220 toward, but not all the way to, the delivery end 1216 of the spray nozzle device 1210. The atomizing zone housing 1222 defines an interior chamber in the spray nozzle device 1210 into which the different phase materials in the inlets 1218, 1220 are delivered from the inlets 1218, 1220 and atomized, similar to as described above.

A plenum housing portion 1224 is another part of the housing of the spray nozzle device 1210 that is fluidly coupled with the atomizing zone housing 1222. The plenum housing portion 1224 extends from the atomizing zone housing 1222 to the delivery end 1216 of the spray nozzle device 1210, and includes the plenum 1246. The plenum housing portion 1224 receives the mixed phase slurry from the atomizing zone housing 1222, similar to as described above. The plenum housing portion 1224 is coupled with several separate delivery nozzles 1226, 1228, 1230 that direct the mixed phase slurry and carrying gas toward the surfaces being coated, as described above. Although not shown in FIG. 12, the nozzles 1226, 1228, 1230 can include the openings into the plenum housing portion 1224 (through which the multi-phase slurry is received from the interior chamber of the plenum housing portion 1224) and the openings from which the multi-phase slurry exits the spray nozzle device 1210. The plenum 1246 is elongated in or along the center axis 1212. In the illustrated embodiment, the inlets 1218, 1220 are not directly coupled with the nozzles 1226, 1228, 1230, but are coupled with the plenum 1246, which is connected with the nozzles 1226, 1228, 1230.

One way in which the spray nozzle device 1210 differs from one or more other embodiments of the spray nozzle devices is the tapered shape of the interior chamber 1246. As shown in FIG. 12, the interior chamber 1246 has a cross-sectional area that decreases at different locations in the flow direction within the device 1210. For example, the cross-sectional area of the interior chamber 1246 at a cross-sectional plane A1 (the interface between the inlets 1218, 1220 and the atomizing zone housing 1222) is larger than the cross-sectional area of the interior chamber 1246 a cross-sectional plane A2 at a location between the upstream and intermediate delivery nozzles 1226, 1228, and is larger than the cross-sectional area of the interior chamber 1246 at a cross-sectional plane A3 at a location that is between the intermediate and downstream delivery nozzles 1228, 1230. The cross-sectional area of the interior chamber 1246 at the plane A2 is larger than the cross-sectional area of the interior chamber 1246 at the plane A3.

Additionally, the spray nozzle device 1210 can differ from one or more other spray nozzle devices disclosed herein in that the delivery nozzles 1226, 1228, 1230 are disposed closer to each other. The delivery nozzles of one or more other spray nozzle devices disclosed herein may be spaced apart from each other in directions that are parallel to the center axes and/or flow directions of the spray nozzle devices. The delivery nozzles 1226, 1228, 1230 of the spray nozzle device 1210 can be closer to each other, as shown in FIG. 12. The nozzles 1226, 1228, 1230 may remain separate from each other in that a small portion of the housing forming the nozzles 1226, 1228, 1230 can extend between neighboring nozzles 1226, 1228, 1230 to keep the multi-phase slurry flowing in one nozzle 1226, 1228, or 1230 separate from the multi-phase slurry flowing in another nozzle 1226, 1228, and/or 1230.

The cross-sectional areas of the nozzle openings and the cross-sectional areas of the interior chamber 1246 can be related. For example, the cross-sectional area of the interior chamber 1246 at the plane A3 can be equal or approximately equal to the difference between the cross-sectional area of the interior chamber 1246 at the plane A2 and the cross-sectional area of the outer opening of the upstream nozzle 1226 (e.g., the opening through which the multi-phase slurry exits the device 1210 through the nozzle 1226). The progressive reduction in cross-sectional areas with increasing length of the interior chamber 1246 can provide for more uniform pressure and delivery of droplets of the multi-phase slurry along the length of the device 1210. This tapered manifold design can prevent the pressure of the multi-phase slurry from dropping across the length of the delivery nozzles 1226, 1228, 1230, and can result in a more uniform delivery of droplets of the multi-phase slurry over all the outer openings of the delivery nozzles 1226, 1228, 1230 when compared to one or more other embodiments described herein.

Figure 13:
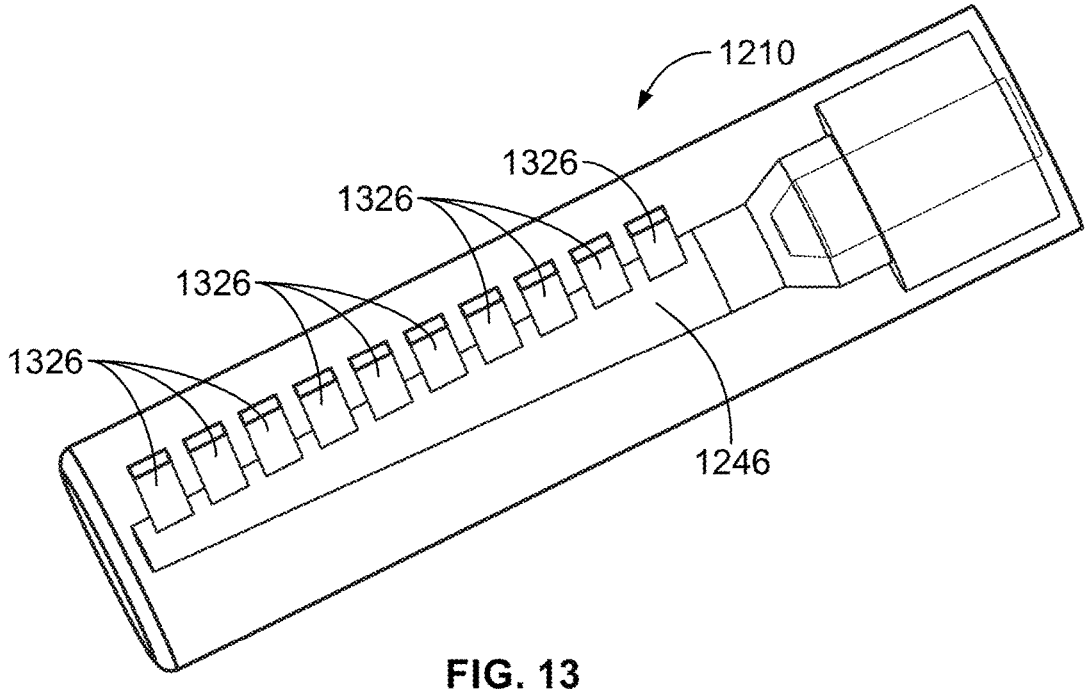
FIG. 13 illustrates another embodiment of the spray nozzle device shown in FIG. 12.

FIG. 13 illustrates another embodiment of the spray nozzle device 1210 shown in FIG. 12. The spray nozzle device 1210 shown in FIG. 13 is longer than the spray nozzle device 1210 shown in FIG. 12, and includes several more delivery nozzles (all labeled 1326 in FIG. 13). The nozzles 1326 in the device 1210 are spaced apart from each other along the flow direction or directions that are parallel to the center axis of the device 1210. The interior chamber 1246 of the device 1210 still has the tapered shape described above.

Figure 14:
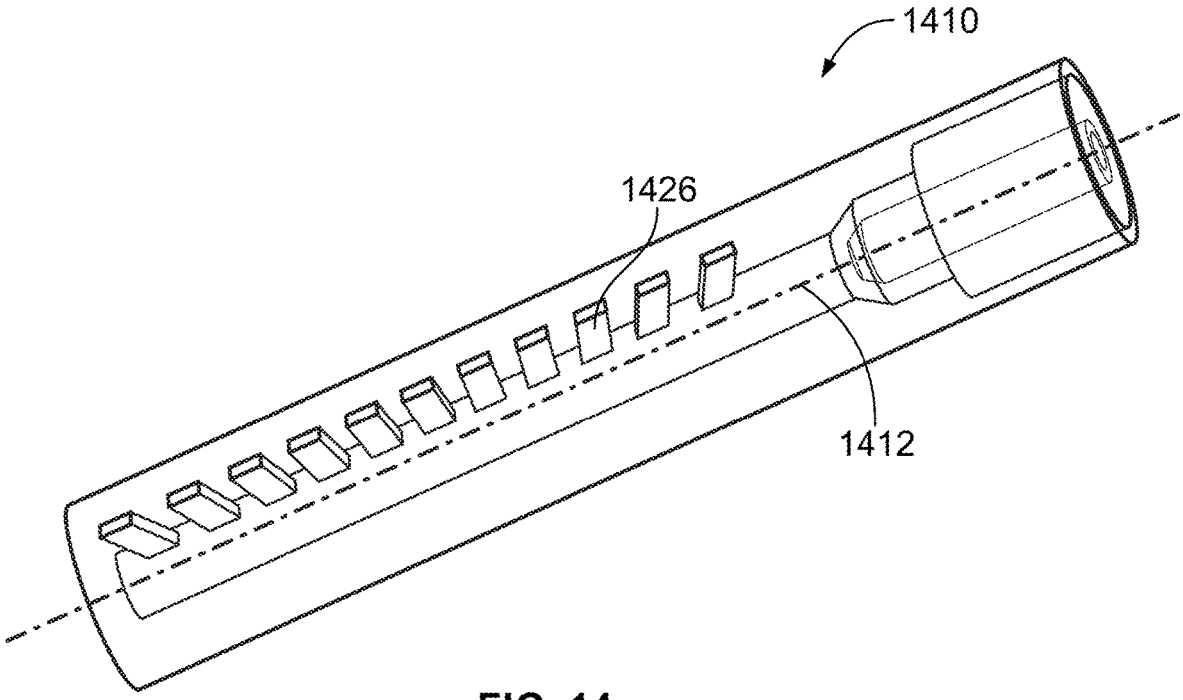
FIG. 14 illustrates a perspective view of another embodiment of an atomizing spray nozzle device.
Figure 15:
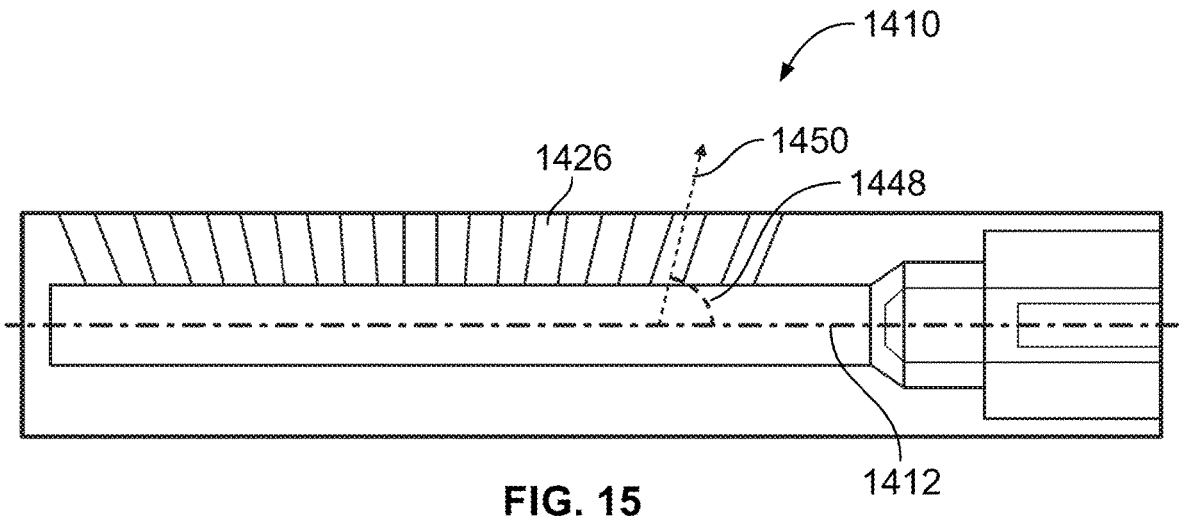
FIG. 15 illustrates a side view of the atomizing spray nozzle device shown in FIG. 14.

FIG. 14 illustrates a perspective view of another embodiment of a spray nozzle device 1410. FIG. 15 illustrates a side view of the spray nozzle device 1410 shown in FIG. 14. The spray nozzle device 1410 is similar to the spray nozzle devices described herein in that the spray nozzle device 1410 includes a housing that defines an interior chamber, inlets that receive materials forming a multi-phase slurry, an atomizing housing zone, and a plenum housing portion. One difference between the spray nozzle device 1410 and the other spray nozzle devices described herein is the different orientations of spray nozzles 1426 of the device 1410. As shown in FIGS. 14 and 15, the delivery nozzles 1426 are oriented at different angles 1448 with respect to a center axis 1412 of the spray nozzle device 1410. The orientation of each delivery nozzle 1426 can be represented by a direction 1450 in which the delivery nozzle 1426 is oriented or a center axis 1450 of the delivery nozzle 1426.

For example, the delivery nozzle 1426 that is farthest upstream relative to the other delivery nozzles 1426 along the flow direction in the spray nozzle device 1410 is oriented at the smallest acute angle 1448 relative to the center axis 1412. The delivery nozzle 1426 that is farthest downstream of the other delivery nozzles 1426 is oriented at the largest obtuse angle 1448 relative to the center axis 1412. The delivery nozzles 1426 located between the farthest upstream and farthest downstream nozzles 1426 are located at different angles 1448, with each delivery nozzle 1426 that is next along the flow direction being oriented at a larger angle 1448 relative to the preceding nozzles 1426.

These orientations of the delivery nozzles 1426 provide for a fan-like arrangement of the nozzles 1426. This arrangement can provide for a larger coverage area that is sprayed by the multi-phase slurry exiting the nozzles 1426.

Figure 16:
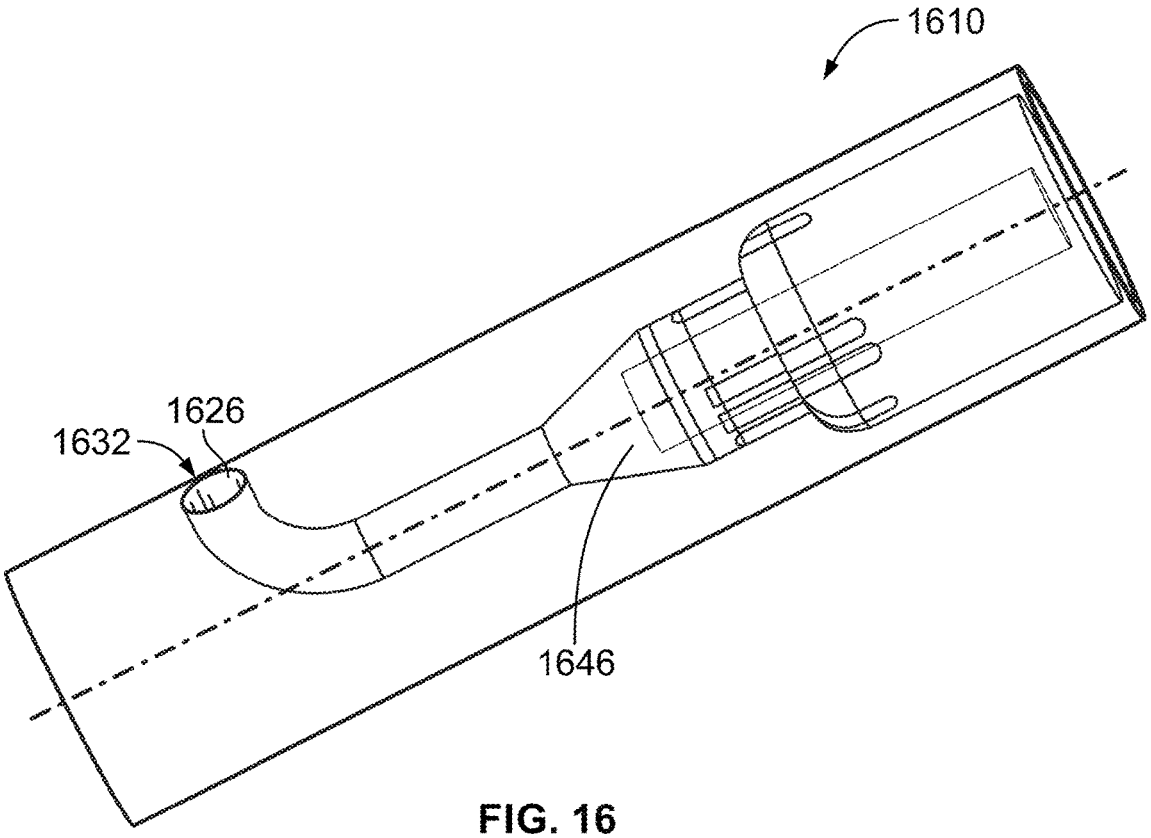
FIG. 16 illustrates a perspective view of another embodiment of an atomizing spray nozzle device.
Figure 17:
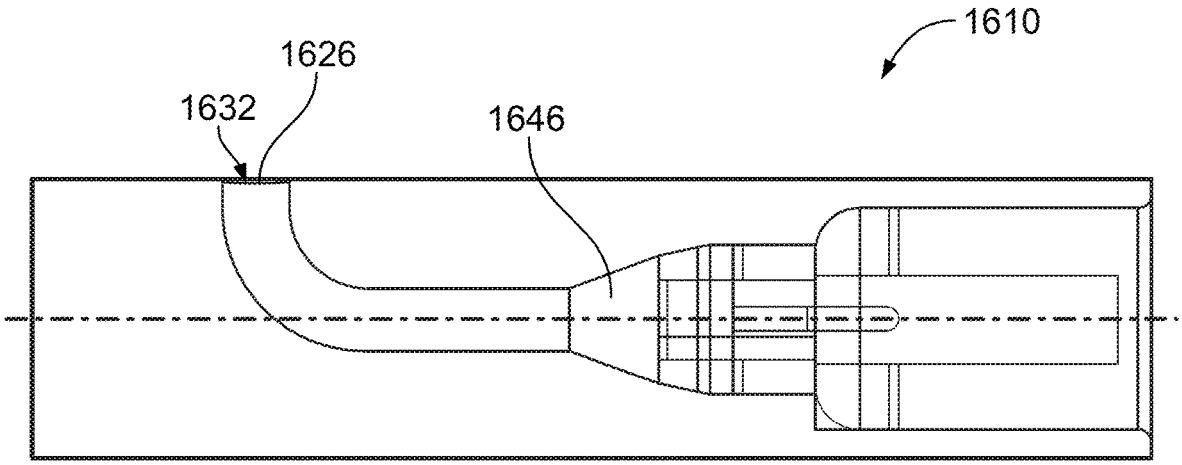
FIG. 17 illustrates a side view of the atomizing spray nozzle device shown in FIG. 16.

FIG. 16 illustrates a perspective view of another embodiment of a spray nozzle device 1610. FIG. 17 illustrates a side view of the spray nozzle device 1610 shown in FIG. 16. The spray nozzle device 1610 is similar to the spray nozzle device 510 shown in FIGS. 5 and 6, except for the shape of the plenum housing portion and delivery nozzle. As shown in FIGS. 16 and 17, an interior chamber or plenum 1646 defined by the housing of the spray nozzle device 1610 has a shape that is curved toward the exterior surface of the spray nozzle device 1610. An outer opening 1632 forms a delivery nozzle 1626 of the device 1610 through which the multi-phase slurry is sprayed onto components of the machine 200. The materials forming this slurry are fed into the plenum 1646 through the inlets described above in connection with the device 510, are atomized and mixed, and flow through the interior chamber 1646 and out of the device 1610 through the opening 1632.

Figure 18:
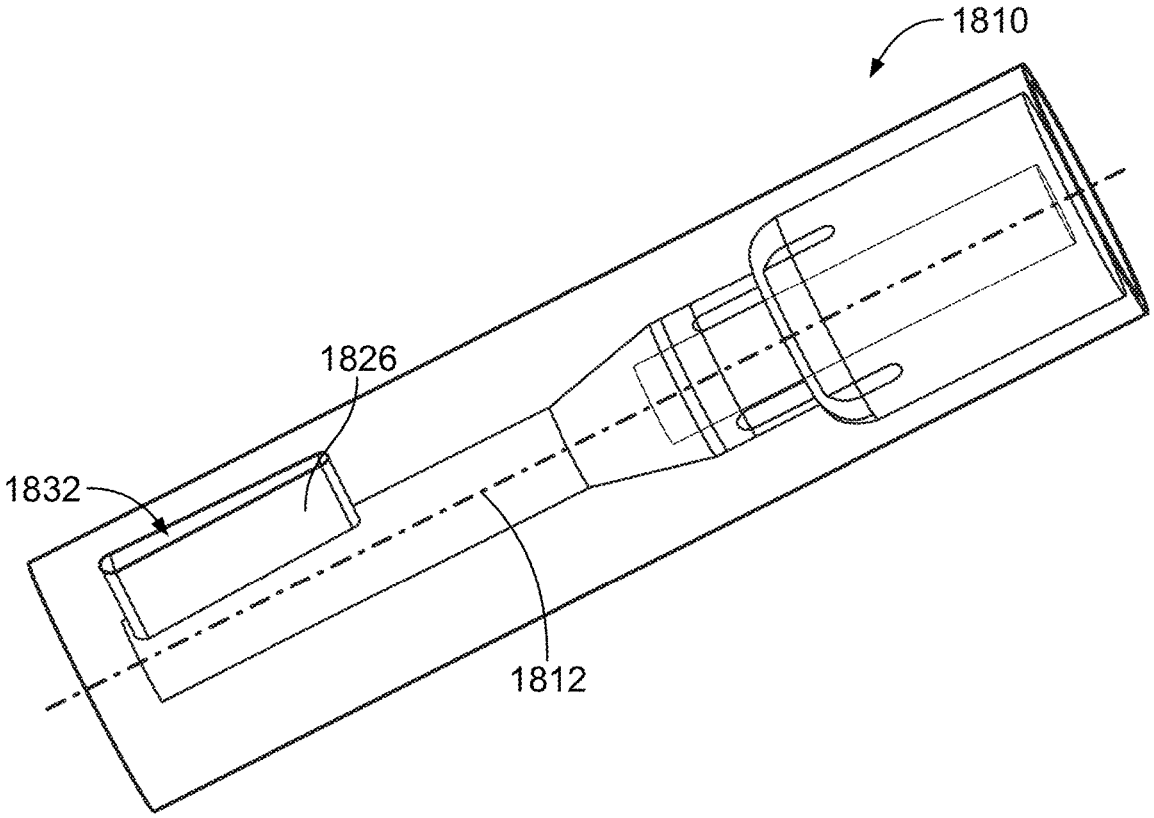
FIG. 18 illustrates a perspective view of another embodiment of an atomizing spray nozzle device.
Figure 19:
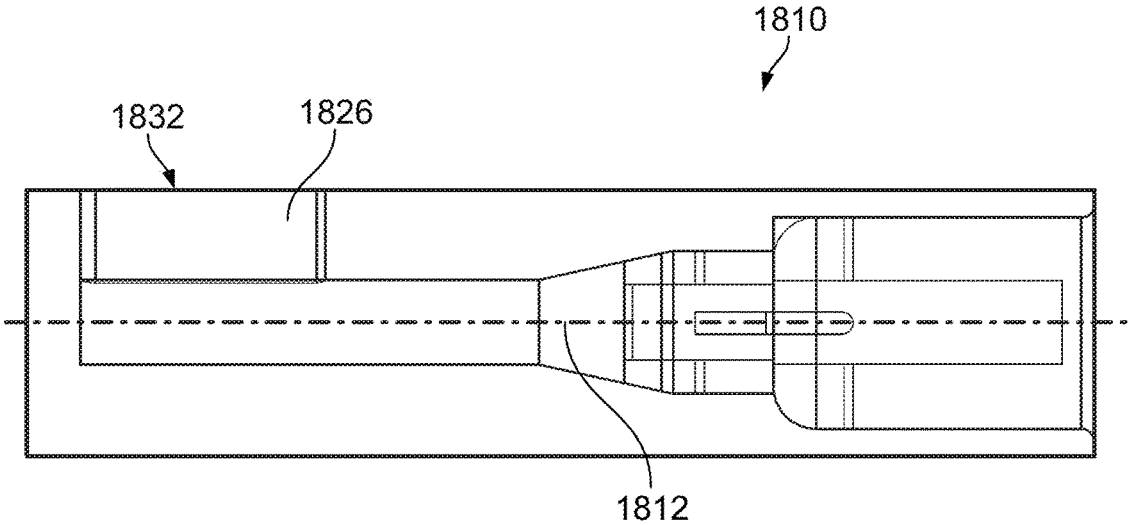
FIG. 19 illustrates a side view of the atomizing spray nozzle device shown in FIG. 18.

FIG. 18 illustrates a perspective view of another embodiment of a spray nozzle device 1810. FIG. 19 illustrates a side view of the spray nozzle device 1810 shown in FIG. 18. Like the other spray nozzle devices described herein, the spray nozzle device 1810 can be used in place of the spray nozzle device 110 described above. The device 1810 is similar to the spray nozzle device 510 shown in FIGS. 5 and 6, except for the shape of a delivery nozzle 1826. As shown in FIGS. 18 and 19, the nozzle 1826 is a radial slot outlet that provides a spray for improved radial coating of a component within the machine 200. The nozzle 1826 has an outer opening 1832 through which the multi-phase slurry exits the device 1810. This opening 1832 is in the shape of an elongated slot, with the slot being elongated along a direction that is parallel to a center axis 1812 of the device 1810. After insertion of the spray nozzle device 1810 in the machine 200, the radial slot opening 1832 on the delivery nozzle 1826 can be oriented perpendicular to the center line of the machine 200 (e.g., the turbine engine) and/or parallel to the radius of the machine 200 (e.g., the turbine engine).

A method for creating one or more of the spray devices disclosed herein can include using additive forming (e.g., three-dimensional printing) to form a single housing body that is the spray device, or to form multiple housings that are joined together to form the spray device.

Figure 20:
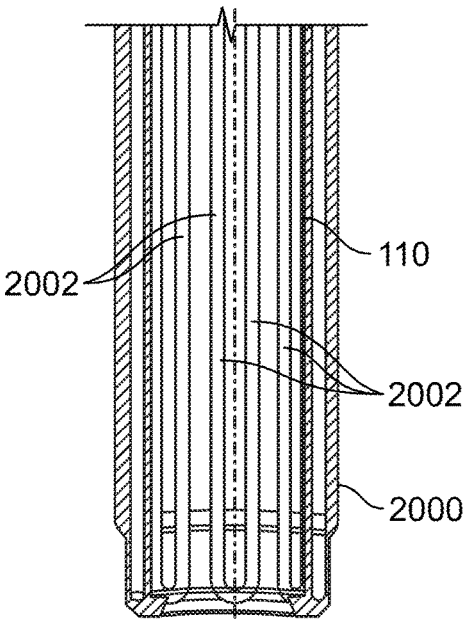
FIG. 20 illustrates one embodiment of a partial view of a jacket assembly.
Figure 21:
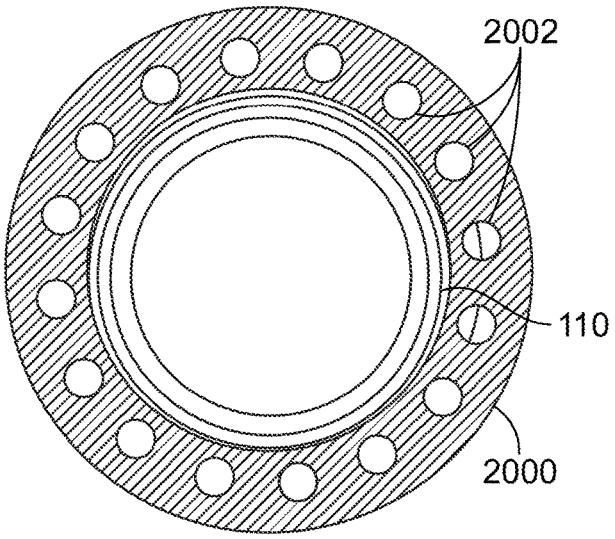
FIG. 21 illustrates a cross-sectional view of the jacket assembly shown in FIG. 20.

FIG. 20 illustrates one embodiment of a partial view of a jacket assembly 2000. FIG. 21 illustrates a cross-sectional view of the jacket assembly 2000. The assembly 2000 can include a flexible or semi-flexible body that extends around the exterior of one or more of the spray delivery devices (e.g., 110) described herein without blocking the inlets or delivery nozzles of the devices. The assembly 2000 includes several conduits 2002 through which a temperature-modifying substance can flow. For example, a coolant (e.g., liquid nitrogen) can be placed in and/or flow through the conduits 2002 to reduce or maintain a temperature of the materials flowing in the spray delivery device inside the assembly 2000. Optionally, a heated fluid can be placed in and/or flow through the conduits 2002 to increase or maintain a temperature of the materials flowing in the spray delivery device inside the assembly 2000.

Use of the assembly 2000 can allow for the spray delivery devices to be used in a range of environments throughout the world having widely varying ambient temperatures. Additionally, the assembly 2000 can assist in preventing residual heat in the machine 200 from preventing the restorative coatings from being applied (e.g., by cooling the coatings). For example, some large commercial turbine engines can take a long time to cool down. If the spray is cooled, then it may not be necessary to wait for the turbine engine to cool to ambient temperature before the coating is applied. The assembly 2000 can be used to cool the slurry prior to introduction of the slurry to the delivery nozzles of the spray devices, can be used to cool the atomizing gas prior to atomizing the slurry in the spray devices, to both cool the slurry and the atomizing gas, etc.

The assembly 2000 can be used to keep the temperature of the atomizing gas and the two-phase slurry within certain desired limits. If the gas temperature is too high, or the two-phase slurry is too high, the quality of the coating can be reduced. If the temperature deviates from the desired temperature range of operating for the spray process, there can be a change in the size of the droplets, the composition of the slurry, the rate of evaporation of the liquid post atomizing and prior to impact of the two-phase droplets on the surface that is being coated. Use of the assembly 2000 can keep the temperatures of the slurry and the gas within desired limits.

Figure 22:
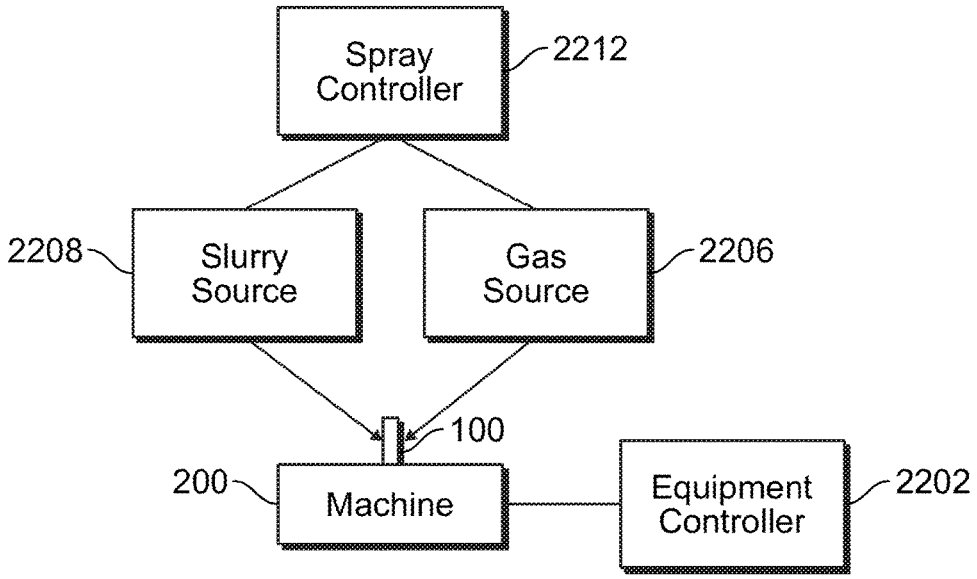
FIG. 22 illustrates one embodiment of a control system.

FIG. 22 illustrates one embodiment of a control system 2200. The control system 2200 can be used to control operation of the machine 200 during spraying of a restorative coating using one or more of the spray devices described herein. The control system 2200 includes an equipment controller 2202 that represents hardware circuitry that includes and/or is connected with one or more processors (e.g., one or more microprocessors, field programmable gate arrays, and/or integrated circuits). These processors control operation of the machine 200, such as by changing a speed at which the machine 200 operates. The equipment controller 2202 can be connected with the machine 200 through one or more wired and/or wireless connections to change the speed at which the machine 200 operates, and optionally to activate or deactivate the machine 200.

A spraying system 2204 controls delivery of the materials (e.g., ceramic particles, liquids, and/or gases) to the spray nozzle device 110 via the spray access tool 100 that is inserted into the machine 200. The spraying system 2204 can control the flow rate, pressure, and/or duration at which a liquid (e.g., water or alcohol), solid (e.g., ceramic particles), and/or gas (e.g., air) are supplied to the device 110 from one or more sources 2206, 2208, 2210, such as tanks or other containers. Optionally, the solid and liquid can be provided from a single source (e.g., a source of the slurry).

The spraying system 2204 can include a spray controller 2212 that controls a pressure of a slurry provided to the device 110, a pressure of a gas provided to the device 110, a flow rate of the slurry provided to the device 110, a flow rate of the gas provided to the device 110, a temporal duration at which the slurry is provided to the device 110, a temporal duration at which the gas is provided to the device 110, a time at which the slurry is provided to the device 110, and/or a time at which the gas provided to the device 110.

The spray controller 2212 represents hardware circuitry that includes and/or is connected with one or more processors, and one or more pumps, valves, or the like of the spraying system 2204, for controlling the flow of materials to the device 110 for spraying a restorative coating onto the interior of the machine 200. The controller 2212 can generate signals communicated to the valves, pumps, etc. via one or more wired and/or wireless connections to control delivery of the materials to the device 110.

In one embodiment, the controllers 2202, 2212 operate in conjunction with each other to add the restorative coating to the interior of the machine 200. For example, the controller 2202 can begin rotating the machine 200 at a slow speed (e.g., no more than one hundred revolutions per minute) prior to or concurrently with the controller 2212 beginning to direct the flow of the slurry and gas to the device 110. The device 110 can then remain stationary inside the machine 200 while the slurry and gas are sprayed onto the interior of the machine 200 during slow rotation of the machine 200. In one embodiment, the device 110 does not move relative to the exterior of the machine 200 during rotation of interior components of the machine 200 and spraying of the restorative coating.

In one embodiment, an atomizing spray nozzle device includes plural inlets disposed at a first end of the device along a center axis of the device. The inlets are configured to receive different phases of materials used to form a coating. The device also includes atomizing zone housing portion fluidly coupled with the inlets and disposed along the center axis of the device. The atomizing zone housing is configured to receive the different phases of the materials from the inlets. The atomizing zone housing is shaped to mix the different phases of the materials into a mixed phase slurry. The device also includes a plenum housing portion fluidly coupled with the atomizing housing portion along the center axis of the device. The plenum housing portion includes an interior plenum that is elongated along the center axis of the device. The plenum is configured to receive the mixed phase slurry from the atomizing zone. The device also includes one or more delivery nozzles fluidly coupled with the plenum. The one or more delivery nozzles provide one or more outlets from which the mixed phase slurry is delivered onto one or more surfaces of a target object as a coating on the target object.

Optionally, the atomizing zone housing portion, the plenum housing portion, and the one or more delivery nozzles are sized to be inserted into one or more of a stage one nozzle borescope opening or a stage two nozzle borescope opening of a turbine engine.

Optionally, the plenum in the plenum housing portion provides for delivery of droplets of the mixed phase slurry from the one or more delivery nozzles that creates a spray of the droplets and a uniform coverage of the coating on the target object.

Optionally, the one or more delivery nozzles are configured to spray the mixed phase slurry onto the one or more surfaces of the target object to apply the coating as a uniform coating.

Optionally, the outer housing is configured to be inserted into a turbine engine to spray the mixed phase slurry onto the one or more surfaces of an interior of the turbine engine without disassembling the turbine engine.

Optionally, the atomizing zone housing portion, the plenum housing portion, and the one or more delivery nozzles are configured to be inserted into a turbine engine to spray the mixed phase slurry onto the one or more surfaces of an interior of the turbine engine without moving the outer housing relative to the turbine engine during spraying of the mixed phase slurry.

Optionally, the atomizing zone housing portion, the plenum housing portion, and the one or more delivery nozzles are configured to be inserted into a turbine engine to spray the mixed phase slurry onto the one or more surfaces of an interior of the turbine engine while one or more components inside the turbine engine rotate.

Optionally, a first inlet of the inlets is configured to receive a mixture of ceramic particles and a liquid fluid into the outer housing and a second inlet of the inlets is configured to receive a gas.

Optionally, the atomizing zone housing portion is configured to atomize and mix the mixture of the ceramic particles and the liquid fluid with the gas as the mixed phase slurry.

Optionally, the second inlet is configured to direct the gas through the atomizing zone housing portion and the plenum housing portion such that the gas carries the mixed phase slurry from the atomizing zone housing portion to the plenum housing portion and out of the plenum housing portion through the one or more delivery nozzles.

Optionally, the one or more delivery nozzles also are configured to atomize the mixed phase slurry as the mixed phase slurry is sprayed toward the one or more surfaces of the target object.

Optionally, the atomizing zone housing portion and the plenum housing portion are elongated along a center axis. The one or more delivery nozzles can be positioned to spray the mixed phase slurry in one or more radial directions from the center axis.

Optionally, the plenum housing portion defines an interior chamber through which the mixed phase slurry flows. The interior chamber can be staged in cross-sectional area such that different upstream and downstream segments of the interior chamber have different cross-sectional areas within the plenum housing portion.

Optionally, the upstream segment of the plenum housing portion has a larger cross-sectional area than the downstream segment of the plenum housing portion.

Optionally, the interior chamber defined by the plenum housing portion includes an intermediate stage between the upstream and downstream segments. The interior chamber of the intermediate stage can have a cross-sectional area that is smaller than the cross-sectional area of the upstream stage but is larger than the cross-sectional area of the downstream stage.

Optionally, a sum of cross-sectional areas of the one or more delivery nozzles in the plenum housing portion is equal to or approximately equal to the cross-sectional area of the interior chamber in the plenum housing portion at an intersection between the inlets and the atomizing zone housing portion.

Optionally, the one or more delivery nozzles include an upstream delivery nozzle, an intermediate delivery nozzle, and a downstream delivery nozzle. An interior chamber of the plenum housing portion through which the mixed phase slurry flows can have a cross-sectional are in a location between the upstream and intermediate delivery nozzles that is equal or approximately equal to a difference between a cross-sectional area of the interior chamber upstream of the upstream delivery nozzle and a cross-sectional area of the upstream delivery nozzle.

Optionally, a cross-sectional area of the interior chamber in a location between the intermediate and downstream delivery nozzles is equal or approximately equal to a difference between the cross-sectional area of the interior chamber in a location between the upstream and intermediate delivery nozzles and the cross-sectional area of the intermediate delivery nozzle.

Optionally, the plenum housing portion defines an interior chamber through which the mixed phase slurry flows. The interior chamber can have a tapered shape in the atomizing zone housing portion such that cross-sectional area of the interior chamber in the atomizing zone housing portion increases along a direction of flow of the mixed phase slurry within the interior chamber.

Optionally, a sum of cross-sectional areas of the one or more delivery nozzles is smaller than the cross-sectional area of the interior chamber at an intersection between the inlets and the atomizing zone housing portion.

Optionally, the plenum housing portion defines an interior chamber through which the mixed phase slurry flows. The interior chamber can have a tapered shape that decreases in cross-sectional area in a direction of flow of the mixed phase slurry in the interior chamber.

Optionally, the one or more delivery nozzles include plural delivery nozzles positioned in a fan arrangement with the nozzles elongated along different directions that are oriented at different angles with respect to a center axis of the atomizing spray nozzle device.

Optionally, the device also includes a jacket assembly disposed outside of the plenum housing portion and the atomizing zone housing portion. The jacket assembly can be configured to hold one or more of a heating material or a cooling material to change or maintain a temperature of the mixed phase slurry flowing through the atomizing spray nozzle device.

In one embodiment, a system includes the atomizing spray nozzle device and an equipment controller configured to control rotation of a turbine engine into which the atomizing spray nozzle device is inserted during spraying of the mixed phase slurry by the atomizing spray nozzle device into the turbine engine.

In one embodiment, a system includes the atomizing spray nozzle device and a spray controller configured to control one or more of a pressure of the slurry provided to the atomizing spray nozzle device, a pressure of a gas provided to the atomizing spray nozzle device, a flow rate of the slurry provided to the atomizing spray nozzle device, a flow rate of the gas provided to the atomizing spray nozzle device, a temporal duration at which the slurry is provided to the atomizing spray nozzle device, a temporal duration at which the gas is provided to the atomizing spray nozzle device, a time at which the slurry is provided to the atomizing spray nozzle device, and/or a time at which the gas provided to the atomizing spray nozzle device.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An atomizing spray nozzle device comprising:

an outer housing;

plural inlets disposed at a first end of the outer housing along a center axis of the outer housing, the inlets configured to receive a fluid and a ceramic material used to form a uniform restorative thermal barrier coating on a target object, wherein the outer housing includes:

an atomizing zone housing portion of the outer housing that is fluidly coupled with the inlets and disposed along the center axis of the outer housing, the atomizing zone housing configured to receive the fluid and the ceramic material from the inlets, the atomizing zone housing shaped to mix the fluid and the ceramic material into two-phase droplets having fluid that evaporates during flight from the atomizing spray nozzle device to the target object;

a plenum housing portion of the outer housing that is fluidly coupled with the atomizing housing portion along the center axis of the device, the plenum housing portion including an interior plenum that is elongated along the center axis of the device, the interior plenum configured to receive the two-phase droplets from the atomizing zone; and delivery nozzles fluidly coupled with the interior plenum, the delivery nozzles provide outlets of the outer housing from which the two-phase droplets are directed toward one or more surfaces of the target object to form the uniform restorative thermal barrier coating on the target object using the ceramic material, wherein all of the delivery nozzles are linearly aligned next to each other along a line that is parallel to the center axis on a common side of the outer housing.

2. The atomizing spray nozzle device of claim 1, wherein the atomizing zone housing portion, the plenum housing portion, and the delivery nozzles are sized to be inserted into one or more of a stage one nozzle borescope opening or a stage two nozzle borescope opening of a turbine engine.

3. The atomizing spray nozzle device of claim 1, wherein the interior plenum in the plenum housing portion provides for delivery of droplets of the two-phase droplets from the delivery nozzles that creates a spray of the two-phase droplets and a uniform coverage of the uniform restorative thermal barrier coating on the target object.

4. The atomizing spray nozzle device of claim 1, wherein the delivery nozzles are configured to spray the two-phase droplets onto the one or more surfaces of the target object to apply the uniform restorative thermal barrier coating.

5. The atomizing spray nozzle device of claim 1, wherein the atomizing zone housing portion, the plenum housing portion, and the delivery nozzles are configured to be inserted into a turbine engine to spray the two-phase droplets onto the one or more surfaces of an interior of the turbine engine without disassembling the turbine engine.

6. The atomizing spray nozzle device of claim 1, wherein the atomizing zone housing portion, the plenum housing portion, and the delivery nozzles are configured to be inserted into a turbine engine to spray the two-phase droplets onto the one or more surfaces of an interior of the turbine engine without moving the atomizing zone housing portion, the plenum housing portion, and the delivery nozzles relative to the turbine engine during spraying of the two-phase droplets.

7. The atomizing spray nozzle device of claim 1, wherein the atomizing zone housing portion, the plenum housing portion, and the delivery nozzles are configured to be inserted into a turbine engine to spray the two-phase droplets onto the one or more surfaces of an interior of the turbine engine while one or more components inside the turbine engine rotate.

8. The atomizing spray nozzle device of claim 1, wherein a first inlet of the inlets is configured to receive a mixture of ceramic particles and a liquid fluid into the outer housing and a second inlet of the inlets is configured to receive a gas.

9. The atomizing spray nozzle device of claim 8, wherein the atomizing zone housing portion is configured to atomize and mix the mixture of the ceramic particles and the liquid fluid with the gas as the two-phase droplets.

10. The atomizing spray nozzle device of claim 9, wherein the second inlet is configured to direct the gas through the atomizing zone housing portion and the plenum housing portion such that the gas carries the two-phase droplets from the atomizing zone housing portion to the plenum housing portion and out of the plenum housing portion through the delivery nozzles.

11. The atomizing spray nozzle device of claim 9, wherein the delivery nozzles also are configured to atomize the two-phase droplets as the two-phase droplets are sprayed toward the one or more surfaces of the target object.

12. The atomizing spray nozzle device of claim 1, wherein the atomizing zone housing portion and the plenum housing portion are elongated along the center axis, and wherein the delivery nozzles are positioned to spray the two-phase droplets in one or more radial directions from the center axis.

13. The atomizing spray nozzle device of claim 1, wherein the plenum housing portion defines an interior chamber through which the two-phase droplets flow, and wherein the interior chamber is staged in cross-sectional area such that different upstream and downstream segments of the interior chamber have different cross-sectional areas within the plenum housing portion.

14. The atomizing spray nozzle device of claim 13, wherein the upstream segment of the plenum housing portion has a larger cross-sectional area than the downstream segment of the plenum housing portion.

15. The atomizing spray nozzle device of claim 14, wherein the interior chamber defined by the plenum housing portion includes an intermediate stage between the upstream and downstream segments, and wherein the intermediate stage has a cross-sectional area that is smaller than the cross-sectional area of the upstream segment but is larger than a cross-sectional area of the downstream segment.

16. The atomizing spray nozzle device of claim 13, wherein a sum of cross-sectional areas of the delivery nozzles in the plenum housing portion is equal to or approximately equal to the cross-sectional area of the interior chamber in the plenum housing portion at an intersection between the inlets and the atomizing zone housing portion.

17. The atomizing spray nozzle device of claim 1, wherein the delivery nozzles include an upstream delivery nozzle, an intermediate delivery nozzle, and a downstream delivery nozzle, wherein an interior chamber of the plenum housing portion through which the two-phase droplets flows has a cross-sectional in a location between the upstream and intermediate delivery nozzles that is equal or approximately equal to a difference between a cross-sectional area of the interior chamber upstream of the upstream delivery nozzle and a cross-sectional area of the upstream delivery nozzle.

18. The atomizing spray nozzle device of claim 17, wherein a cross-sectional area of the interior chamber in a location between the intermediate and downstream delivery nozzles is equal or approximately equal to a difference between the cross-sectional area of the interior chamber in a location between the upstream and intermediate delivery nozzles and the cross-sectional area of the intermediate delivery nozzle.

19. The atomizing spray nozzle device of claim 1, wherein the plenum housing portion defines an interior chamber through which the two-phase droplets flows, and wherein the interior chamber has a tapered shape in the atomizing zone housing portion such that cross-sectional area of the interior chamber in the atomizing zone housing portion increases along a direction of flow of the two-phase droplets within the interior chamber.

20. The atomizing spray nozzle device of claim 19, wherein a sum of cross-sectional areas of the delivery nozzles is smaller than the cross-sectional area of the interior chamber at an intersection between the inlets and the atomizing zone housing portion.

21. The atomizing spray nozzle device of claim 1, wherein the plenum housing portion defines an interior chamber through which the two-phase droplets flow, and wherein the interior chamber has a tapered shape that decreases in cross-sectional area in a direction of flow of the two phase evaporative droplets in the interior chamber.

22. The atomizing spray nozzle device of claim 1, wherein the delivery nozzles include plural delivery nozzles positioned in a fan arrangement with the nozzles elongated along different directions that are oriented at different angles with respect to a center axis of the atomizing spray nozzle device.

23. The atomizing spray nozzle device of claim 1, further comprising a jacket assembly disposed outside of the plenum housing portion and the atomizing zone housing portion, the jacket assembly configured to hold one or more of a heating material or a cooling material to change or maintain a temperature of the two-phase droplets flowing through the atomizing spray nozzle device.

24. A system comprising:

an atomizing spray nozzle device including:

inlets disposed at a first end of the device along a center axis of the device, the inlets configured to receive a fluid and a ceramic material used to form a uniform restorative thermal barrier coating on a target object;

an atomizing zone housing portion fluidly coupled with the inlets and disposed along the center axis of the device, the atomizing zone housing configured to receive the fluid and the ceramic material from the inlets, the atomizing zone housing portion shaped to mix the fluid and the ceramic material from the inlets into two-phase droplets having a liquid fluid that evaporates during flight from the atomizing spray nozzle device to the target object;

a plenum housing portion fluidly coupled with the atomizing housing portion along the center axis of the device, the plenum housing portion including an interior plenum that is elongated along the center axis of the device, the plenum housing portion configured to receive the two-phase droplets from the atomizing zone; and delivery nozzles providing outlets from which the two-phase droplets are directed toward one or more surfaces of the target object to form the uniform restorative thermal barrier coating on the target object using the ceramic material, wherein all of the delivery nozzles are linearly aligned next to each other on a common side of the device, wherein the plenum housing portion effects droplet spray from the delivery nozzles.

25. The system of claim 24, further comprising:

an equipment controller configured to control rotation of a turbine engine into which the atomizing spray nozzle device is inserted during spraying of the two-phase droplets by the atomizing spray nozzle device into the turbine engine.

26. The system of claim 24, further comprising:

a spray controller configured to control one or more of a pressure of the ceramic material provided to the atomizing spray nozzle device, a pressure of a gas provided to the atomizing spray nozzle device as the fluid, a flow rate of the ceramic material provided to the atomizing spray nozzle device, a flow rate of the gas provided to the atomizing spray nozzle device, a temporal duration at which the ceramic material is provided to the atomizing spray nozzle device, a temporal duration at which the gas is provided to the atomizing spray nozzle device, a time at which the ceramic material is provided to the atomizing spray nozzle device, or a time at which the gas provided to the atomizing spray nozzle device.

* * * * *